United States Patent [19]

Critchell et al.

[11] 4,341,248

[45] Jul. 27, 1982

[54] PORTABLE SAWMILL

[75] Inventors: Kenneth G. Critchell, Dover; James M. Brown, Jr., Sand Point, both of Id.

[73] Assignee: Pack River Management Company, Hayden Lake, Id.

[21] Appl. No.: 231,541

[22] Filed: Feb. 4, 1981

Related U.S. Application Data

[62] Division of Ser. No. 969,645, Dec. 14, 1978, abandoned.

[51] Int. Cl.[3] ..... B27B 1/00; B27B 29/08

[52] U.S. Cl. ..... 144/378; 83/471.2; 83/708; 83/717; 83/719; 83/721

[58] Field of Search ..... 83/708, 714, 717, 719, 83/720, 721; 144/312

[56] References Cited

U.S. PATENT DOCUMENTS

| | | | |
|---|---|---|---|
| 358,899 | 3/1887 | Strong | 83/708 |
| 3,056,438 | 10/1962 | McColl | 83/721 |
| 3,066,709 | 12/1962 | Bale et al. | 83/717 |
| 3,133,724 | 5/1964 | Shashaty et al. | 83/719 X |
| 3,747,457 | 7/1973 | Thompson | 83/471.2 |

*Primary Examiner*—Donald R. Schran

*Attorney, Agent, or Firm*—Townsend and Townsend

[57] ABSTRACT

A portable sawmill system comprising at least three wheeled, independently movable modules is disclosed. The modules are independently maneuverable to a land site having a ready source of logs to be processed and are arranged in a preselected geometrical configuration adjacent one another and the source of logs. A log from the source is received on the first module and debarked. The debarked log is moved axially and transversely off the first module and onto a second module. A plurality of saw means are carried by the second module to form boards from a log being processed. A third module is located at the output side of the second module and is adapted to receive and further process the boards formed on the second module.

2 Claims, 34 Drawing Figures

PORTABLE SAWMILL

This is a division of application Ser. No. 969,645, filed 12/14/78 now abandoned.

BACKGROUND OF THE INVENTION

The present invention relates to sawmills, and in particular to a modular portable sawmill which performs the basic functions of a conventional sawmill.

The lumber industry has reached a condition of severe depression because of a number of factors. The retail price of lumber has risen to the point where public resistance is such that a further increase in prices will drastically curtail demand. Yet, at the same time, the cost in producing the lumber is rising inexorably. The lumber industry is caught between price stagnation and cost inflation and as a result, only the most efficient lumber operations are currently profitable, and less efficient operations are in the process of being abandoned. For even the most efficient lumber operations, the return on the operation is diminished to the point where it is minimal and increased capitalization of such operations is commercially impractical.

Although many factors enter into the escalation of the costs of lumber production, the two most significant factors are first, increases in wages paid employees, and second, dwindling supplies of large diameter timber adjacent existing conventional sawmills. Conventional sawmills are only partially automated and require a large number of laborers. As a result, the cost of lumber production is inexorably tied to wage inflation for existing sawmills. In addition, such mills are adapted to process relatively large diameter logs. The supply of such logs adjacent existing conventional sawmills has, to a large extent, been developed. Thus, the sawmills are forced to operate using small logs which they are not equipped to handle efficiently, or must pay increased transportation costs to bring the logs from outlying areas to the sawmill.

Even though the supply of large diameter timber in the vicinity of existing sawmills has been depleted, there remain other sources of timber. Specifically, smaller diameter timber exists in large quantities in many areas. In addition, small and large diameter timber exists in quantity in locations remote from existing sawmills. However, as discussed above, such supplies of timber cannot be efficiently harvested by conventional sawmill facilities.

SUMMARY OF THE INVENTION

The present invention provides a portable sawmill system comprising at least three wheeled, independently movable modules. The modules are independently maneuverable to a land site having a ready source of logs to be processed and are arranged in a preselected geometrical configuration adjacent one another and the source of logs. A log from the source is received on the first module and debarked. The debarked log is moved axially and transversely off the first module and onto a second module. A plurality of saw means are carried by the second module to form boards from a log being processed. A third module is located at the output side of the second module and is adapted to receive and further process the boards formed on the second module.

The apparatus of the present invention has three primary advantages. First, the sawmill is portable so that it can be moved to the timber supplies which are remote from existing sawmills but which are not sufficiently large themselves to warrant the construction of a fixed site sawmill. Second, the portable sawmill of the present invention substantially reduces the number of laborers required in the sawmill operation. Third, relatively small diameter logs can be handled efficiently and the maximum amount of lumber obtained from them for reasons discussed in more detail hereinafter. Because of these factors, the portable sawmill of the present invention allows for the production of lumber from existing timber supplies at far less cost than was previously possible, making such lumber production a commercially fessible endeavor.

In the preferred embodiment of the present invention, the portable sawmill comprises three independently movable vehicular modules. Each module includes a truck trailer containing certain sawmill components. The three truck trailers can be moved from site to site by truck tractors. In each location, the trailers are positioned adjacent one another to provide an entire sawmill.

The first trailer of the preferred embodiment includes a loading station having a hoist provided with a grapple which lifts the logs and loads them onto the first trailer. A chopping saw chops the logs into log sections of the desired length for processing while the log is held in place by the grapple. The log passes through a conventional debarker on the first trailer and through a anti-flail tunnel to a debarke routfeed. The waste product of the debarker is conveyed to a chipper which proceses the refuse into chips from which are dispensed onto a refuse trailer.

The logs are swept off of the debarker outfeed and pass along an unloader which extends partially over the second trailer. The debarked logs are dropped individually onto the set works on the second trailer which is rotated upwardly to receive the logs. The logs are dogged to the set works, and the set works is then rotated downwardly through an arc of approximately 45° to position the log in the path of a radial saw.

A radial saw is located on a saw carriage which reciprocates back and forth along the second trailer. The logs are dogged so that they cannot move upwardly in order that the radial saw can cut a section from the log as it passes in each direction along the length of the log (the radial saw urges the log upwardly when the saw passes in one direction and downwardly when it passes in the opposite direction). The log sections drop onto a roll case on the second trailer which conveys these sections to a slabber and edger also located on the second trailer which form the log sections into boards.

The boards from the slabber and edger pass onto the third trailer. On the third trailer, the logs pass beneath an optical sensor having a transverse array of sensor elements which sense the width of the leading edge of the board. This transverse array of sensor elements determines where the width of the board begins to diminish, and a longitudinal array of sensor elements determines the length of the board which has a constant width. In response to these sensor elements, the board is stopped automatically along the third trailer so that the position at which it begins to taper is adjacent a trim saw which trims off the tapered end of the board. The entire trim operation is fully automated. The trimmed board is then loaded onto a truck adjacent the third trailer and the spent or tapered end is passed to a chipper. The chipper includes a blower which transfers the chips from the spent end together with the chips formed by the slabber and edger to a chip trailer so that the chips can be used for particle board and other applications and are not wasted.

The fundamental operations of the portable sawmill of the present invention, namely, the sawing, slabbing, edging and trimming, are all controlled by a sawyer located at a sawyer station on trailer 2. Another laborer, called a landing man, is required to operate the hoist on trailer 1. In addition, a third laborer, called a roustabout, is required to handle miscellaneous tasks in the vicinity of the sawmill. In essence, therefore, only three individuals are required to operate the sawmill of the present invention. This is in constrast to conventional sawmills having equivalent capacity where eight to twelve persons would be required to perform the same operations.

The portable sawmill described above acts to maximize the production of usable lumber from relatively small logs. The set works is adapted to adjust to small logs as well as large logs to place them efficiently before the saw. Furthermore, the set works rotate the logs after they have been dogged through an arc of approximately 45° for sawing. It has been found that when a bent log is dropped onto the set works, the opposite ends of the bent log will point downwardly. Cutting of the bent log in this position is relatively inefficient because each board that is cut is crescent shaped and much of the log is therefore unusable. However, when the log is rotated through the 45° arc, the production of usable lumber from the bent log is maximized. Thus, the most possible lumber is obtained from relatively small, bent timber which cannot be efficiently processed by conventional sawmills.

Another feature of the portable sawmill of the present invention which maximizes the production of usable lumber from relatively small logs is that the sawmill of the present invention does not utilize the saw/resaw technique used most conventional mills. In conventional mills, the first sawyer station slabs the log and cuts the log into one or more sections. However, the remainder of the log is often passed through the first sawyer station to a resaw station which saws this portion of the log into further sections. The amount of sawing and resawing is balanced to facilitate smooth operation of the sawmill. However, such reliance on the saw/resaw capability results in a relatively inefficient handling of small logs because excess dogging and undogging time is required for logs in which relatively little usable lumber can be obtained. However, the sawmill of the present invention does not rely on a resaw capability and therefore is more readily adapted to handle smaller logs.

The preferred embodiment of the present invention described above includes the capacity for forming round and slabbed poles as well as flat lumber. If a round pole is to be found, the pole merely passes along the debarker outfeed until it drops off the first trailer and does not pass to the second trailer. If a slabbed log or flat lumber is desired, a stop is raised at the end of the debarker outfeed so that the log cannot pass off the end of the trailer. The log is swept off the debarker outfeed, passes along the loader and is engaged by the set works. If a slabbed log is to be formed, a single cut is made with the saw, and the roll case on the second trailer is operated in reverse so that the slabbed log is dumped off of the end of the second trailer opposite from the slabber and edger to provide a slabbed pole (the slab from the pole is processed into flat lumber in the usual manner). If the log is to be cut into flat lumber, the roll case is operated in the normal direction and the log is fully cut into sections which pass to the slabber and edger and on to the third trailer. Thus, as timber is being processed, those logs which are best suited for making round poles can be processed into round poles, those best suited for slab poles can be processed into slab poles, and those best suited to flat lumber can be processed into flat lumber without interrupting in any way the operation of the portable sawmill.

In the preferred embodiment of the present invention, the set works prevents upward as well as downward movement of the log which is engaged in the set works. This allows for the use of a radial saw which can cut the log in either direction. Conventional sawmills ordinarily employ a band saw which can only cut in a single direction, reducing by half the number of cuts which can be made in a given amount of time by a radial saw. An even greater advantage of the radial saw is that it very seldom needs sharpening whereas a band saw must be sharpened as often as once an hour. Each time the band saw is to be sharpened, it must be removed and replaced with a new band saw blade, shutting down the operation of the sawmill as often as once an hour just to replace a saw blade. Replacement of the band saw blade takes several minutes and significantly reduces the operating time of sawmills using this type of saw. This reduction in operating time does not occur with the sawmill of the present invention which allows for the use of a radial saw.

The novel features which are believed to be characteristic of the invention, both as to organisation and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 26 being taken along lines 26—26 of FIG. 25;

DESCRIPTION OF THE PREFERRED EMBODIMENTS

General Description

Figure 1:
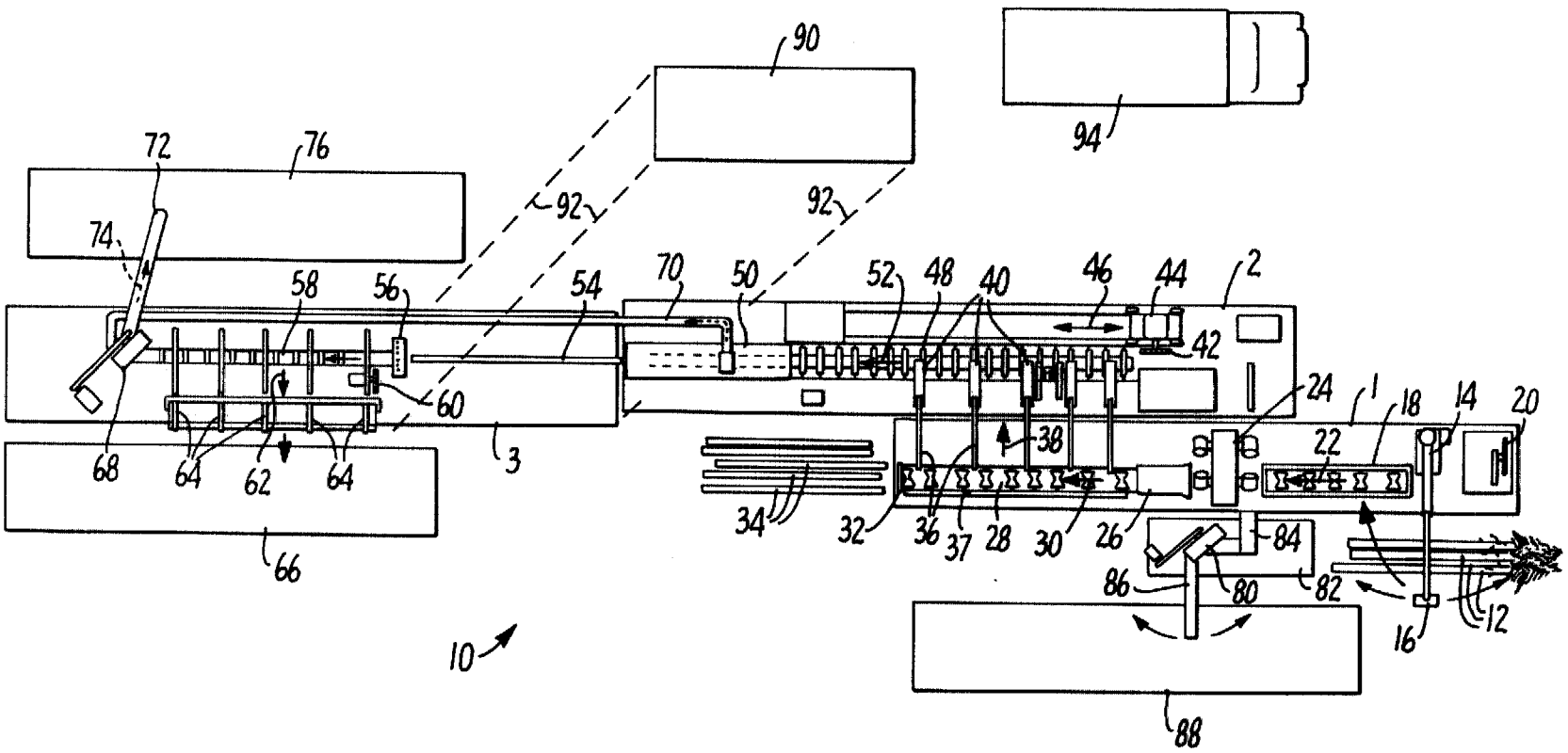
FIG. 1 is a plan view of the portable sawmill of the present invention assembled at a site where logs are to be processed.

The overall construction of the preferred embodiment of the portable sawmill 10 of the present invention is illustrated by way of reference to FIG. 1. Sawmill 10 includes three truck trailers numbered 1, 2 and 3 containing the various elements which comprise the sawmill. Trailers 1, 2 and 3 can be moved individually by truck tractors from one site to another, and at any given site can be located as illustrated at the selected site to provide the sawmill. Specifically, trailers 1 and 2 are placed side-by-side in a partially overlapping configuration, and the bed of trailer 3 is placed end-to-end with the bed of trailer 2. Trailers 1-3 are aligned, stabilized and interconnected in position to provide a rigid, stable platform for the sawmill operation.

Logs 12 which are to be processed are initially loaded onto trailer 1 by a hoist 14 located on trailer 1. Logs 12 are engaged by the grapple 16 at the end of hoist 14 and placed on a first roll case 18 and held in position by the grapple. Logs 12 are always loaded butt down so that the larger end of the log is always loading in subsequent processing. The logs are cut to size by a chopping saw 20 located at the end of trailer 1, and the portion of the log forward of chopping saw 20 is processed further.

Roll case 18 acts as a debarker infeed to move the chopped log in the direction indicated by arrow 22 into a conventional debarker 24 located on trailer 1. As the logs pass through debarker 24, the bark is removed, and the logs pass through an anti-flail tunnel 26 after leaving the debarker and onto a roll case 28 as illustrated by arrow 30 which acts as a debarker outfeed.

If the log section on debarker outfeed 28 is to be used to form a round pole, a stop 32 at the end of debarker outfeed 28 is depressed and the log passes off off trailer 1 onto the ground. Such logs eventually collect on the ground to form a stack of round poles 34. If the log is not to be used as a round pole, stop 32 is raised and the log remains on debarker outfeed 28 for further processing.

A log on debarker outfeed 28 which is to be further processed is swept off of the outfeed by sweep 37 and passes along loader 36 as illustrated by arrow 38 to a preselected position over trailer 2. From this position, the logs are dumped individually onto a set works 40 and secured thereto. Set works 40 positions the log in the path of a radial saw 42 mounted to saw carriage 44 which reciprocates back and forth along trailer 2 as illustrated by arrow 46.

If the log is to be processed into a slab pole, i.e. a pole which has one or more flat sides but is otherwise round, only the slabs are cut from the pole. When the appropriate slabs have been cut, the pole is dropped on roll case 48, which operates in reverse from the direction indicated by arrow 52 and drops the slabbed pole off the front of trailer 2. The slabs themselves are processed in the normal manner into flat lumber as described hereinbelow.

If the log is to be processed into flat lumber, the log is cut into a plurality of sections. During each pass of the radial saw 42, a log section is cut from the log engaged by the set works and falls onto roll case 48. Each log section which falls on roll case 48 is transferred to a slabber and edger 50 on trailer 2 as illustrated by arrow 52. Slabber and edger 50 slabs the log sections if necessary and edges them to form boards which pass onto trailer 3.

A conveyor belt 54 on trailer 3, called an edger picker, accepts the board emmanating from slabber and edger 50 and transfers it along trailer 3. An optional sensing system is provided on trailer 3 which includes a transverse array 56 of sensor elements. Array 56 measures the width of the leading end of the board passing along edger picker 54, and determines when the board begins to taper (the constant width portion is always leading because the logs are loaded butt end first). When such a determination is made, a longitudinal array of sensor elements (not shown on FIG. 1) senses the length of the board which has a constant width. The optical sensing system causes a stop to be raised along roll case 58 on which the board is traveling so that the point at which the log begins to taper is adjacent trim saw 60. Trim saw 60 is then actuated to trim the tapered end from the board and the trimmed board is moved transversely across trailer 3 as illustrated by arrow 62 to a stacker 64. Stacker 64 takes the board and lifts it onto a truck 66 which takes the lumber to the point of distribution.

The slabber portion of the edger and slabber 50 basically comprises a chipping head which chews the rounded side of the slab into chips. The edged portion of the log section and the tapered end of the board are carried by a conveyor (not shown in FIG. 1) to another chipper 68. Chipper 68 includes a blower which sucks the chips from the slabber through a conduit 70, where they are mixed with the chips from chipper 68 and discharged through conduit 72 as illustrated by arrow 74 to a chip trailer 76. The chips in trailer 76 can be used for particle board or various other applications, and are not wasted.

Another chipper 80 is located on a relatively small trailer 82 adjacent debarker 24. A conveyor 84 on trailer 1 pivots out and over trailer 82 and conveys the refuse from debarker 24 to chipper 80. Chipper 80 processes the refuse into chips and transfers the refuse through conduit 86 to a refuse trailer 88. By using the system of chippers which includes the slabber portion of slabber and edger 50, chipper 68 and chipper 80, all of the log is used in some manner and none of the log is wasted.

Power for portable sawmill 10 is contained in a power unit 90 adapted to be placed over edger picker 54 on trailer 3, as illustrated by dash lines 92. As an alternate embodiment, the power unit can be placed on an independent truck trailer and located adjacent the portable sawmill. Power unit 90 is supplied from a fuel truck 94, and contains generators and hydraulic power supplies which operate the entire portable sawmill. Hence, the sawmill is entirely self-contained and need not rely on external sources of power other than fuel.

Operation

Figures 2, 3:
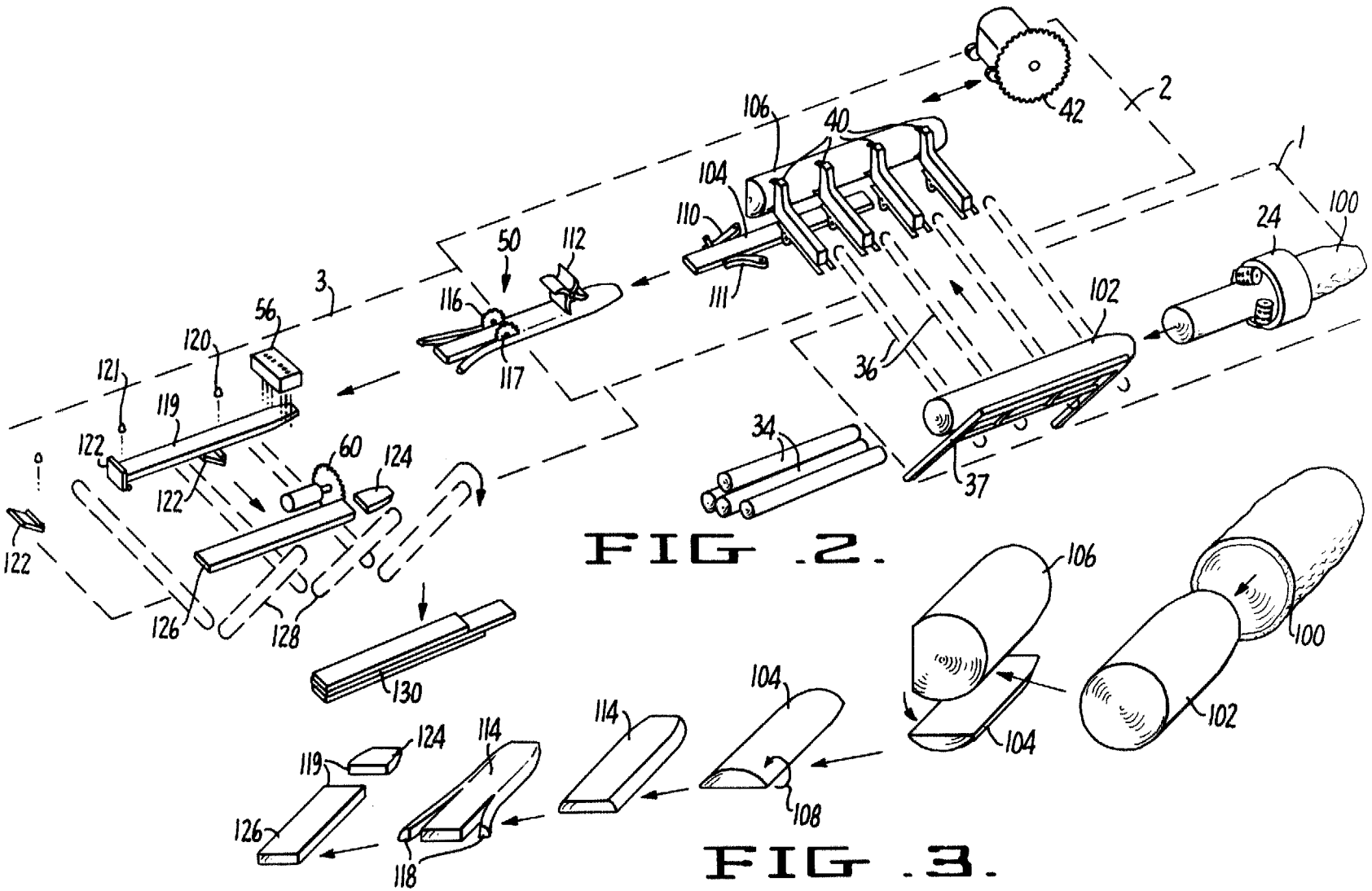
FIG. 2 is a schematic view illustrating the various functional operations of the portable sawmill of the present invention.
FIG. 3 illustrates schematically the log processing steps of the portable sawmill as depicted in FIG. 2.

The functional operation of the portable sawmill is illustrated by way of reference to FIGS. 2 and 3 in combination. Initially, a log section 100 which has been cut to the appropriate length is passed through debarker 24 on trailer 1 which removes the bark from the log. The debarked log 102 emerges from debarker 24 and passes onto the debarker outfeed. Sweep 37 rolls the log off of the debarker outfeed and onto loader 36 which drops it onto set works 40. The debarked log is engaged by the set works and rotated through an angle of approximately 45°, as will be illustrated hereinafter, and placed by the set works in the path of radial saw 42. Before each pass of radial saw 42, the log is advanced further into the path of the saw so that a log section such as 104 is cut from the log and drops onto the roll case (not shown) on trailer 2. The remaining slabbed log 106 remains engaged with set works 40 for the cutting of another log section. The first and last sections cut from each log will have only one flat side, such as section 104, whereas intermediate sections will have two parallel flat sides.

Log section 104 is turned as illustrated by arrow 108 so that the flat side is down and centered by members 110, 111 on the roll case and passed to slabber and edger 50 on trailer 2. Slabber 112 cuts off the rounded slab portion of log section 104 to form a board 114. Log sections having two flat sides need not be slabbed and pass untouched beneath slabber 112. The blades 116, 117 of the edger cut the rounded edges from 118 from board 114, leaving a board 119.

Board 119 passes beneath the transverse array 56 of optical sensors which determine the point at which board 119 begins to taper. At this point, a longitudinal array of sensors such as 120, 121 sense the length of the constant width portion of the board and actuate one of the stops 122 so that the point at which the board begins to taper is adjacent trim saw 60. As board 119 moves transversely across trailer 3, trim saw 60 cuts off the tapered end 124, leaving a constant width board 126. This board is raised by stacker 128 and dropped onto a pile of such boards 130. The boards on pile 130 are thereafter sorted and further processed to make finished lumber.

Trailer 1—Detailed Description

Figure 4:
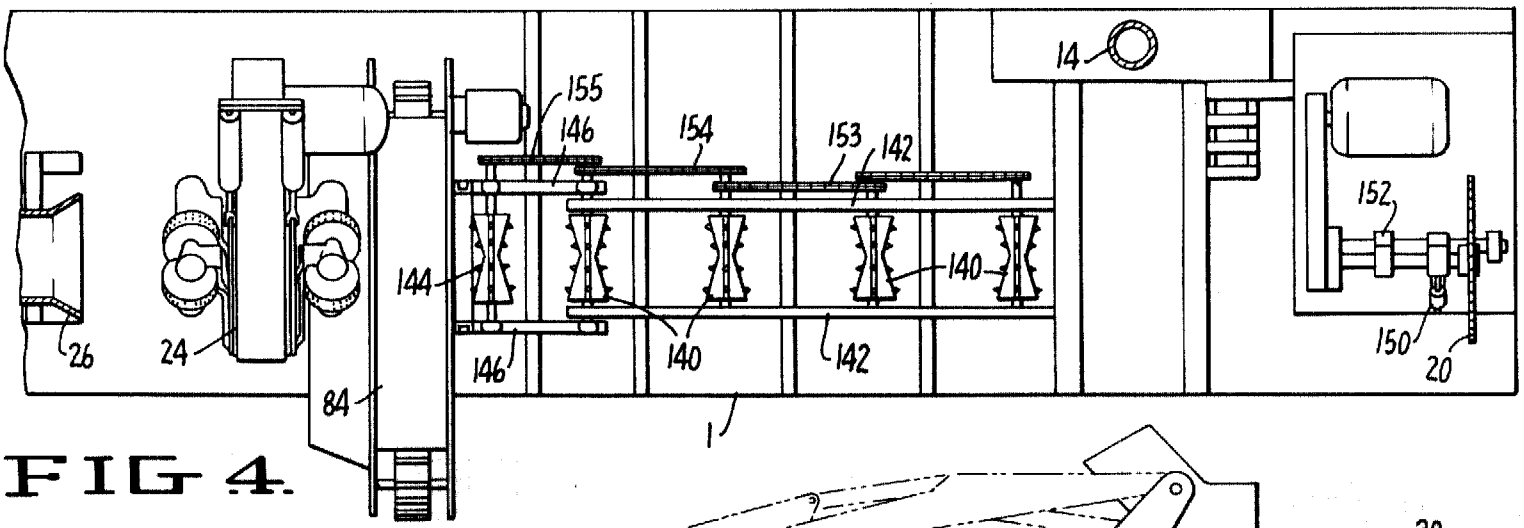
FIGS. 4 and 5 are plan and elevation views respectively of the upstream portion of trailer 1 up to and including the debarker.
Figure 5:
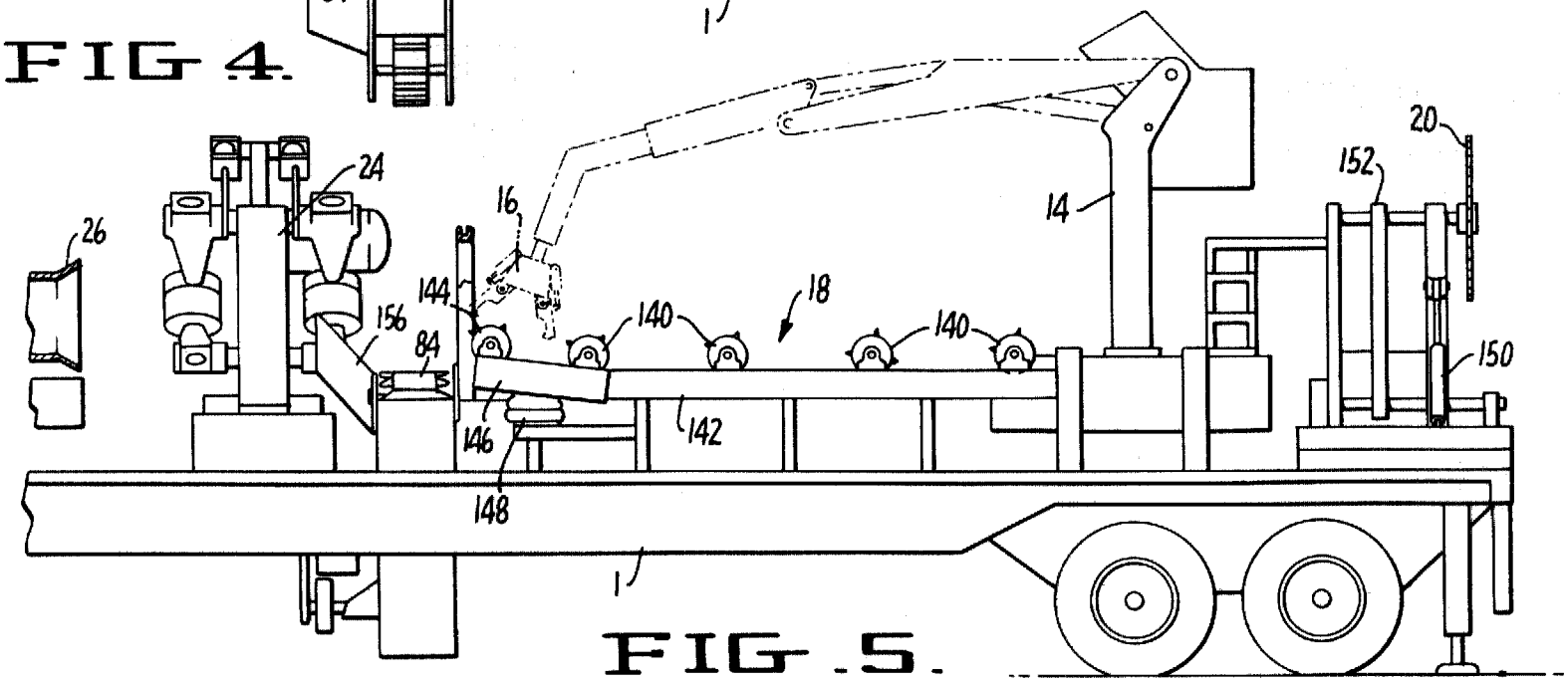

The upstream portion of trailer 1 of the present invention is illustrated in more detail by way of reference to FIGS. 4 and 5 in combination. Trailer 1 includes a hoist 14 adapted to lift logs from the ground and place them on the roll case 18 forming the debarker infeed. Roll case 18 comprises a plurality of spiked driven rollers 140 mounted on support 142. A forward roller 144 is located at the downstream end of debarker infeed 18 and is mated to an upwardly inclined structure 146 which lifts the log into debarker 24. Structure 146 is mounted on a pneumatic shock absorber 148 so that agitation of the log as it is processed by debarker 24 does not damage roll case 18.

After the log is lifted onto roll case 18, it is held in place on the roll case by grapple 16. The preferred embodiment of the portable sawmill illustrated herein is adapted to process logs up to 20 feet in length. If the basic log as hoisted exceeds 20 feet, chopping saw 20 is actuated and hydraulic cylinder 150 acts to pivot the support 152 of the chopping saw downwardly. Chopping saw 20 thus cuts the log to a length not to exceed 20 feet and the remainder of the log drops off the forward end of trailer 1. This log remainder can later be hoisted onto the sawmill and processed into lumber.

If the log on debarker infeed 18 is less than 20 feet in length, or has been chopped by chopping saw 20, roll case 18 is then actuated to move the log into debarker 24. Rollers 140 and 144 are driven by belts 153, 154, 155 to feed the log into the debarker. As the bark is being removed from the log, it falls into a chute 156 which dumps the bark and other refuse onto a conveyor 84, which transfers such refuse to the refuse trailer illustrated in FIG. 1. Refuse conveyor 84 is pivotably mounted to trailer 1 so that it can be folded within the dimensions of the trailer during movement of the sawmill from place to place, but folds out to extend over the infeed for the refuse chipper when the sawmill is in place.

After the logs pass through the debarker, they enter an anti-flail tunnel (FIGS. 6 and 7) which guides the logs from the debarker onto the roll case 28 which acts as the debarker outfeed. Debarker outfeed 28 comprises a plurality of V-shaped rollers 160 aligned with anti-flail tunnel 26.

Rollers 160 are powered by belts 162 so that the log moves along roll case 28 until it reaches stop 32 which is normally upwardly raised as indicated. However, if the log is to be used as a round pole, hydraulic actutor 164 is used to drop stop 32 so that the log passes completely along roll case 28 and is dropped off the trailing end of trailer 1. However, if the log is to be further processed into either a slabbed pole or into flat lumber, stop 32 is maintained in its normal upwardly raised position and the log is stopped when it reaches the end of roll case 28.

Figure 6:
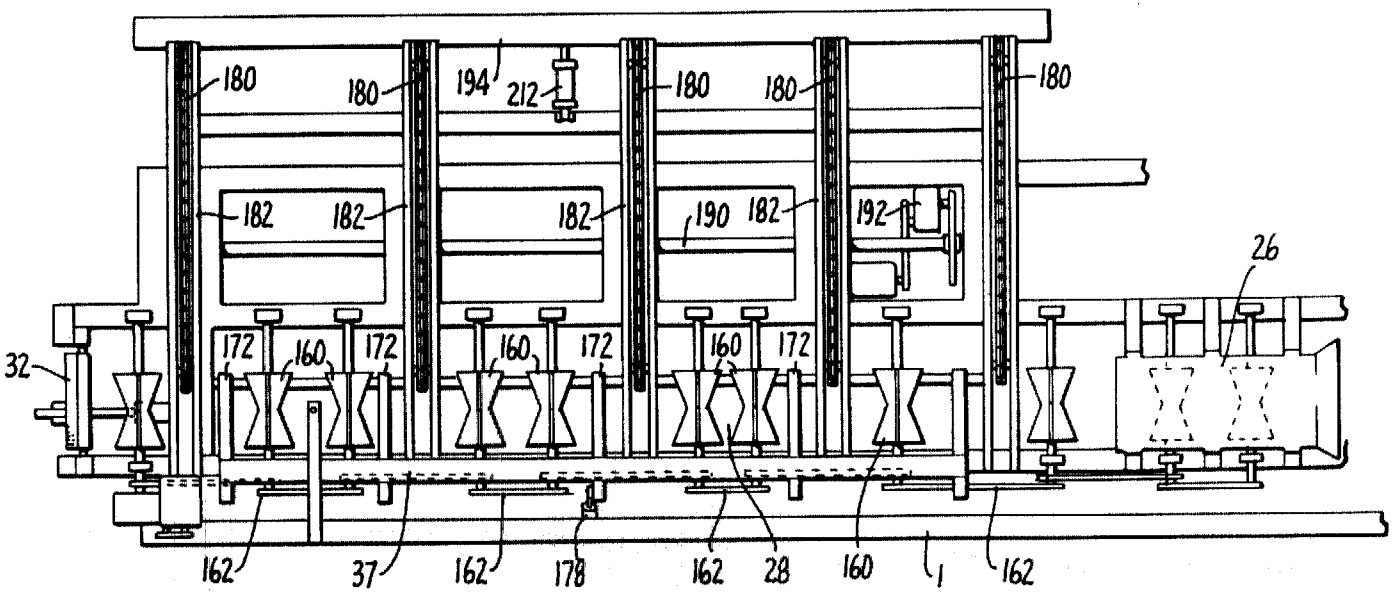
FIGS. 6 and 7 are plan and elevation views respectively of the portion of trailer 1 downstream of the debarker.
Figure 7:
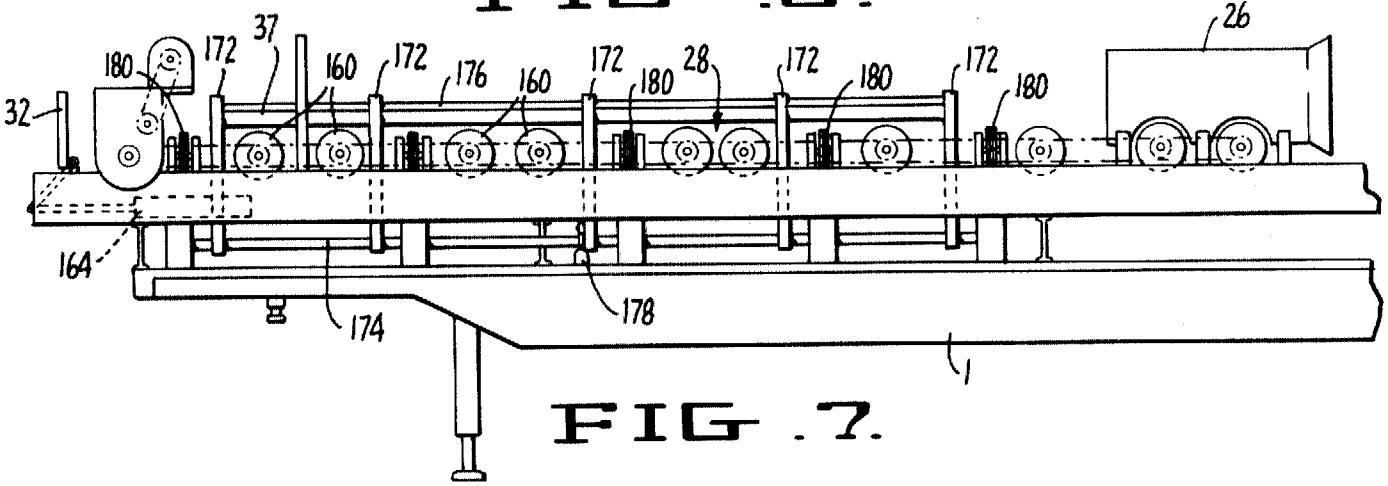
Figure 12:
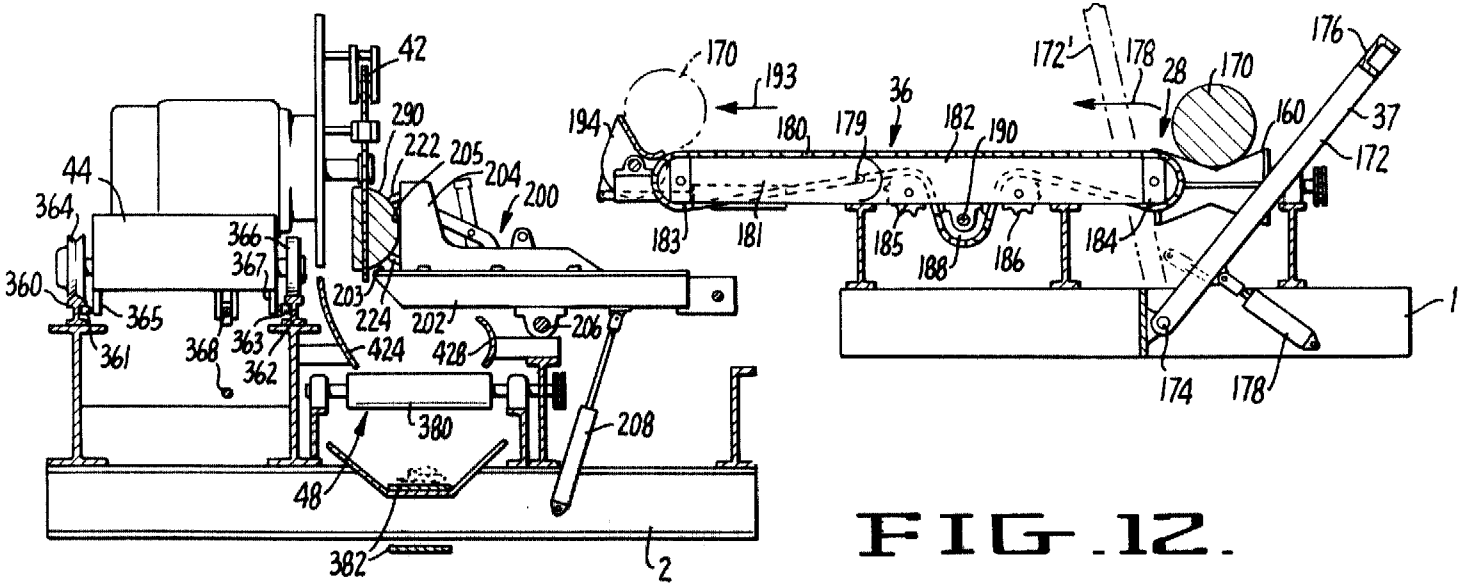
FIG. 12 is a sectional view of the loading portion of the trailer 1 and the set works portion of trailer 2.

A log such as 170 on debarker outfeed 28 is moved off of the outfeed by a sweep 37 for further processing, as illustrated by FIG. 6, 7 and 12 in combination. Sweep 37 comprises a plurality of upstanding members 172 connected at their lower ends to a common rod 174. The upper ends of upstanding members 172 are connected by a beam 176 which provides structural rigidity to sweep 37.

A hydraulic actuator 178 is located along sweep 37 and connected to respective upstanding members 172. Hydraulic actuator 178 is actuated to move sweep 37 so that the upstanding members 172 thereof pass between the rollers 160 comprising debarker outfeed 28 to the position 172' illustrated in FIG. 12. Log 170 is thus moved off rollers 160 as illustrated by arrow 178 onto loader 36.

As illustrated by FIGS. 6 and 12 in combination, loader 36 comprises a plurality of continuous chains 180. Each chain 180 is located on an armature 182, and wraps around sprockets 183, 184 at the opposite ends of the armature. A pair of idler sprockets 185, 186 guide the chain so that it is wrapped around a drive sprocket 188. Each drive sprocket 188 is located on a drive shaft 190 powered by electric motor 192 to move the chain. Chains 180 are moved so that the log 170 rides along the upper surface of loader 36 as illustrated by arrow 193 until it reaches stop 194 which is located over trailer 2. The outboard portion 181 of armature 182 which extends over trailer 2 is pivotable about pin 179 to a vertical position so that it is within the confines of trailer 1 during the transportation thereof.

Trailer 2—Detailed Description

As discussed hereinabove, set works 40 is located on trailer 2. Set works 40 includes a plurality of knees 200 depicted in FIGS. 8, 12 and 13. Knees 200 will be described in more detail hereinafter, but basically include a lower member 202 normally disposed in a horizontal configuration, and an upper member 204 normally disposed in a vertical configuration. Members 202, 204 have complementary interior surfaces 203, 205 normally maintained in horizontal and vertical planes respectively.

Each lower member 202 of the respective knees 200 is connected to a common shaft 206. Upper members 204 are mounted on lower members 202 so that each knee 200 is pivotable as a unit about shaft 206. The pivoting of the knees 200 is controlled by a hydraulic actuator 208, and knees 200 pivot in unison about shaft 206.

Figure 13:
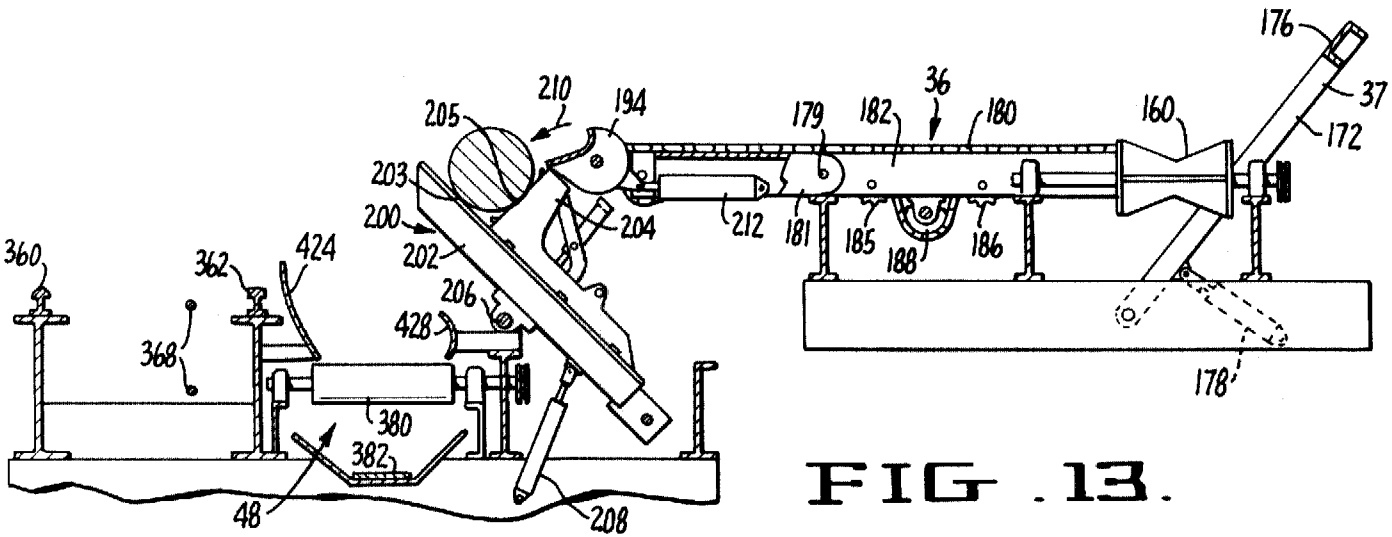
FIG. 13 is a view similar to that of FIG. 12 illustrating the loader loading a log into the set works.

When a log is to be engaged with set works 40, the respective knees 200 are pivoted from the position illustrated in FIG. 12 to that illustrated in FIG. 13 by hydraulic actuator 208. In the configuration illustrated in FIG. 13 the respective interior faces 203, 205 of members 202, 204 are disposed in an upwardly opening V-shape. With knees 200 in this configuration stop 194 can be rotated as illustrated by arrow 210 by hydraulic actuator 212 (see FIG. 6) to dump the outermost log on loader 36 into knees 200. The shape of stop 194 is such that only one log at a time can be dispensed into knees 200 even through more than one log may be located on loader 36.

Figure 14:
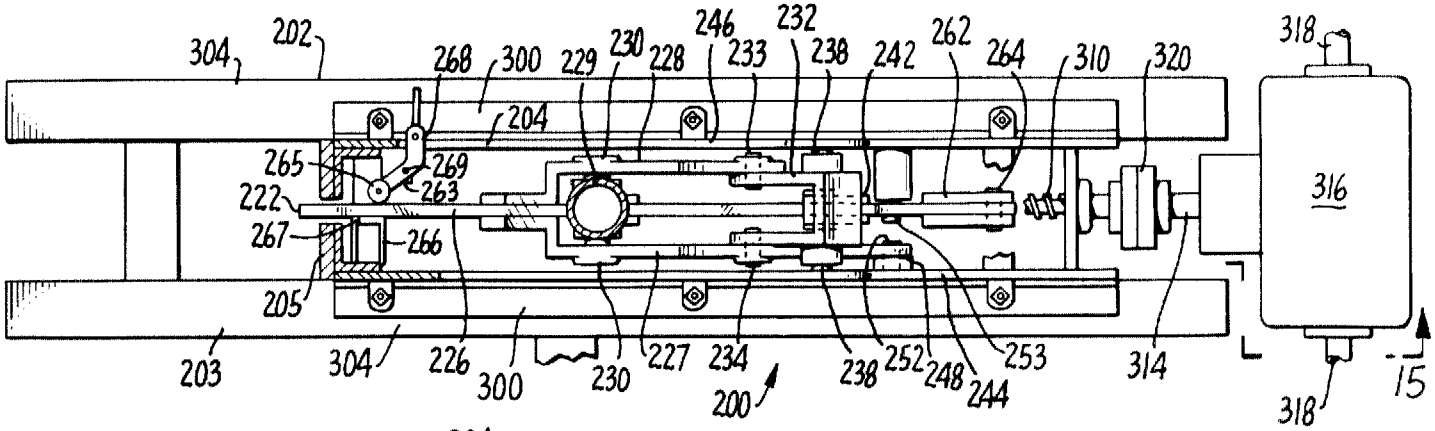
FIG. 14 is a plan view of one of the dogs and knees on trailer 2.
Figure 15:
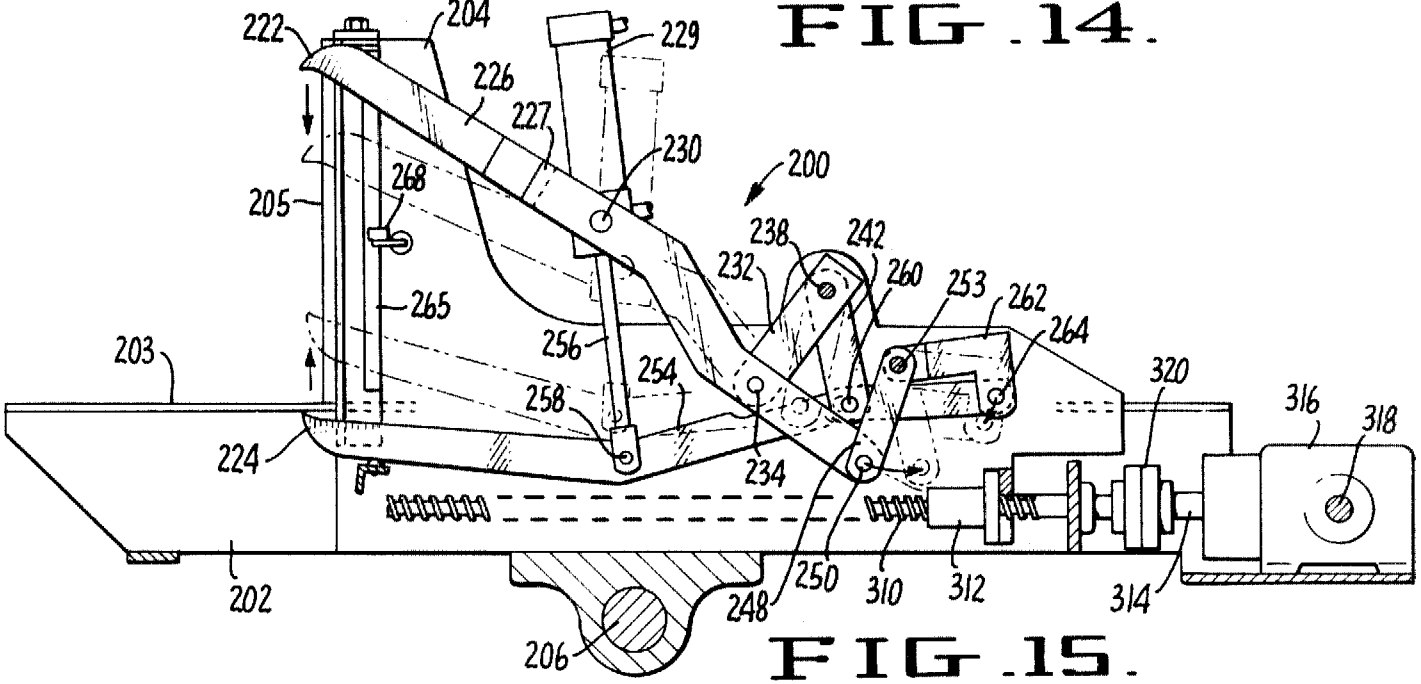
FIG. 15 is a sectional elevational view taken along lines 15—15 of FIG. 14.

The construction of each of the knees 200 and their associated dogging apparatus is illustrated in way of reference to FIGS. 14 and 15. As discussed previously, each knee 200 includes an upper member 204 having a surface 205 which is normally vertical. Lower member 202 has a corresponding surface 203 which, together with surface 205, is adapted to support the log. The log supported on surfaces 203 and 205 is engaged between an upper dog 222 and a lower dog 234 to secure the log to knee 200.

The upper dog 222 of each knee 200 is located at the tip of an armature 226 which is welded or otherwise connected to a pair of depending arms 227, 228. Each of the arms 227, 228 is connected to the depending portion of a U-shaped swing arm 232 by pin connectors 233, 234. The upper end of swing arm 232 is connected to the sidewalls 244, 246 of the upper member 204 of knee 200 by pin 233. The trailing end of arm 227 is connected to tail link 248 by pin 250. The upper end of tail link 248 is fixed to sidewall 244 by pin connector 252.

Hydraulic actuator 229 is connected to arms 227, 228 by pin connectors 230. When actuator 229 is actuated to engage a log between drops 222 and 224, upper dog 222 is forced downwardly at pin connectors 230 by actuator 229. Arms 227 and 228 swing around the connection 238 of swing arm 232 to member 204. Also, the trailing end of arm 227 swings around the connection 252 of tail link 248 to member 204. As a result of the actions of the swing arm 232 and tail link 248, upper dog 222 moves downwardly nearly parallel with the face 205 of member 204. Downward movement of upper dog 222 is preferably not exactly parallel to face 205, but upper dog 222 moves slightly inwardly toward the face as the dog moves downwardly.

The lower dog 224 of each knee 200 is at the tip of an armature 254. Armature 254 is connected to the shaft 256 of hydraulic actuator 229 by pin connector 258. Armature 254 is also connected by pin 260 to the lower end of swing arm 242. The upper end of swing arm 242 is connected by pin 238 to the walls 244, 246 of the upper member 204 of knee 200. The trailing end of armature 254 is connected to an L-shaped tail link 262 by pin 264. The forward end of tail link 262 is connected by pin 253 to sidewall 244 of member 204.

When hydraulic actuator 229 is actuated to engage a log between upper dog 222 and lower dog 224, upper dog 222 initially moves downwardly as directed above until it engages the log. Then, lower dog 224 is urged upwardly by actuator 229 at pin 258. Armature 254 pivots about swing arm 242 with the swing arm rotating in a clockwise direction, and also about tail link 262. In this manner lower dog 224 moves upwardly in a direction nearly parallel to face 205 of member 204. As with upper dog 222, it is preferred that lower dog 224 moves slightly inwardly as it moves upwardly.

As discussed hereinabove, a log section is out from the log engaged by dogs 222, 224 during each pass of the radial saw. When the saw makes a pass in one direction, the log will be urged downwardly against surfaces 203 of knees 200. However, when the radial saw passes in the other direction, the log will be urged upwardly.

To prevent the log from moving upwardly when urged upwardly by the radial saw, dogs 222, 224 are locked in position. A cylindrical pipe 265 is fixed to a bracket 268. Bracket 268 is pivotally connected to flange 263 emanating from sidewall 204 by pin 269. When bracket 268 is actuated by a hydraulic actuator (not shown), cylindrical pipe 265 biases dogs 222,224 against brake lining 267. Brake lining 267 is mounted on a flange 266 proximate dogs 222,224 so that when cylindrical pipe 265 is actuated, the dogs are firmly locked in position and the log cannot move upwardly.

Figure 8:
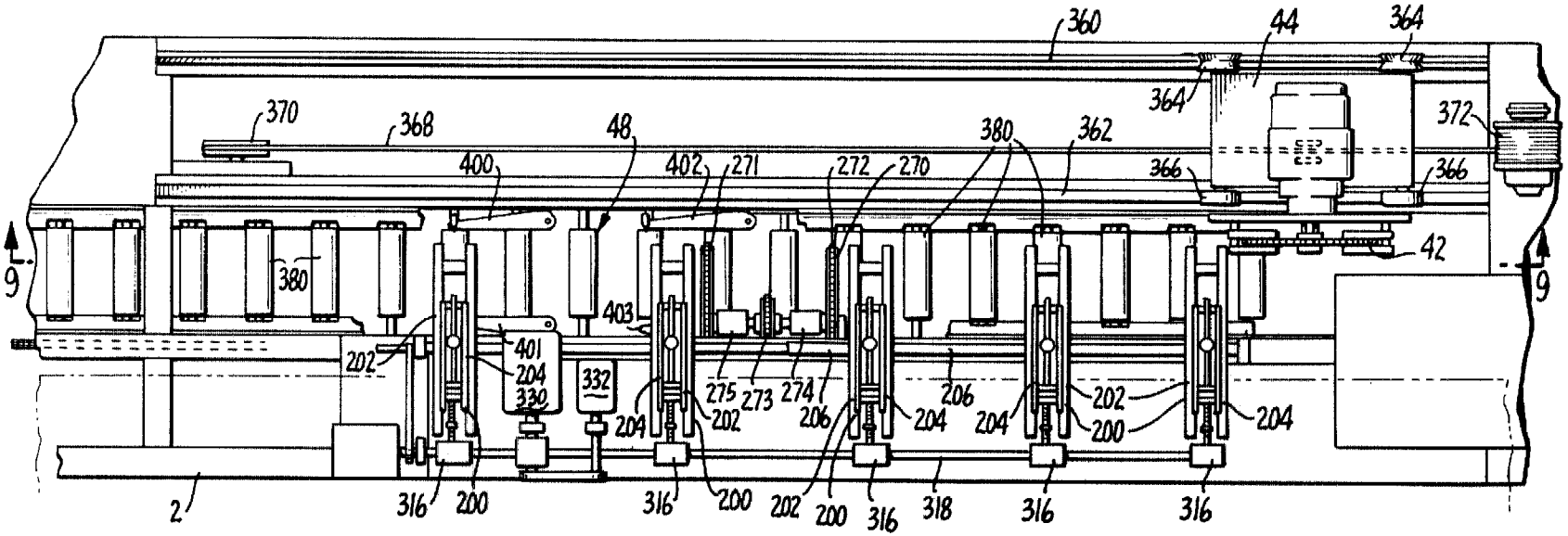
FIGS. 8 and 9 are plan and elevation views respectively of the upstream portion of trailer 2.

Before the log is out by the saw, or after certain cuts have been made but the log is not totally sectioned, it may be desirable in certain instances to turn the log. For this purpose, a log turner system including a pair of horizontal log turners 270, 271 and a vertical log turner 273 are located intermediate knees 200, as illustrated in FIG. 8.

Figure 16:
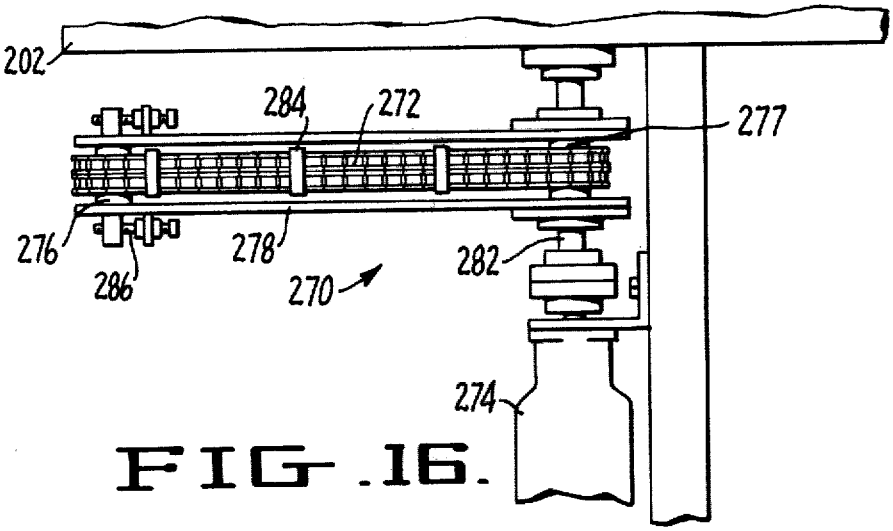
FIGS. 16 and 17 are fragmentary plan and elevation views respectively of the log turner on trailer 2.
Figure 17:
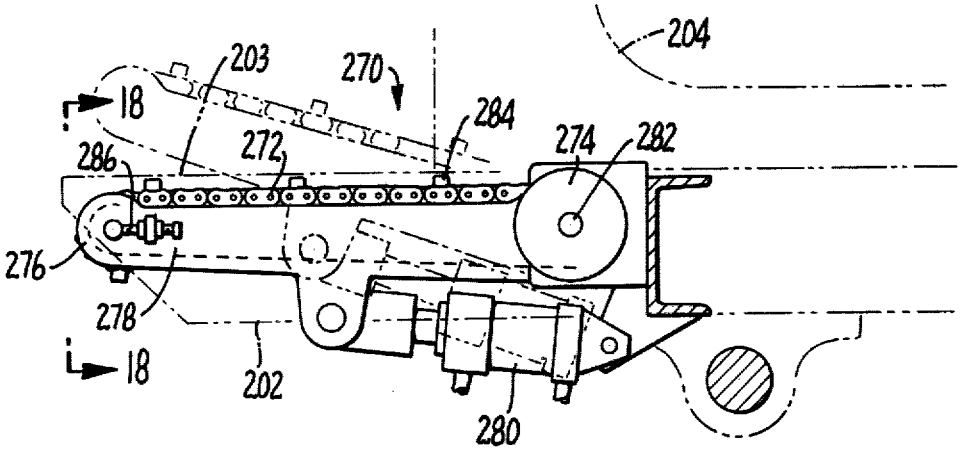
Figure 18:
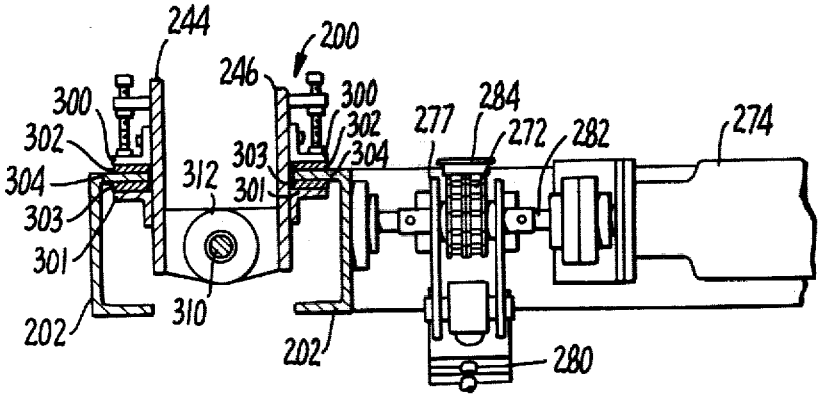
FIG. 18 is a sectional view taken along lines 18—18 of FIG. 17.

The construction of each log turner such as 270 is illustrated in more detail by way of reference to FIGS. 16–18. Turners 271, 273 are similar and are not illustrated separately. Chain 272 circumscribes sprockets 276,277 at the opposite ends of a member 278. Member 278 is normally disposed so that the chain 272 is below the face 203 of member 202 on which the log rests. However, if the log is to be turned, hydraulic actuator 200 pivots member 278 upwardly through a small angle about drive shaft 282 so that the teeth 284 on chain 272 engage the lower surface of the log. Vertical log turner 273 is pivoted forwardly through a small angle so that it also engages the log. Motors 274, 275 are then actuated to drive sprocket 277 and move the chains to turn the log.

The log turning system can only be utilised when the log is not engaged between dogs 222, 224. Hence, the log turning operation is only performed when knees 202 have been pivoted to their upwardly raised configuration illustration in FIG. 13 so that the log does not fall out of the knees as it is being turned. After turning, the log is engaged by the dogs and knees 200 are pivoted downwardly to the configuration illustrated in FIG. 12 for sawing of the log.

When a log such as 290 has been secured by dogs 222, 224 and knees 200 pivoted to their operating position illustrated in FIG. 12, the log is advanced into the path of radial saw 42 by moving the upper members 204 and 200 toward the path of the saw. Dogs 222, 224 are fixed to upper members 204 so that movement of the upper members of the knees moves log 290 as well. As illustrated in FIGS. 14 and 18, the sidewalls 244, 246 of each knee 200 have pairs of upper and lower L-shaped brackets 300, 301 on each side thereof. Bushing members 302, 303 are interposed between L-shaped brackets 300, 301 and the upper flanges 304 of lower member 202. Upper member 204 is thus translatable along the length of lower member 202.

Movement of upper member 204 along lower member 202 is controlled by a jack screw 310 illustrated in FIGS. 14, 15 and 18. Jack screw 310 threadably engages collar 312 on upper member 204 so that rotation of the jack screw moves upper member 204 relative to lower member 202. Jack screw 310 is connected to the output shaft 314 of a right angle box 316 by coupling 320, as illustrated in FIG. 14. A drive shaft 318, which is powered as illustrated hereinbelow, passes through right angle gear box 316 and provides power to shaft 314.

As illustrated in FIG. 8, the movement of each upper member 204 along the associated lower member 202 is controlled by a separate right angle gear box 316. Each gear box 316 is in turn powered by a single shaft 318 interconnecting the various gear boxes 316. Shaft 318 in turn is powered by a pair of motors 330, 332 illustrated in more detail in FIGS. 19 and 20.

Motor 330 is a two-speed electric motor capable of operating a speeds of both 600 and 1000 r.p.m. The output shaft 334 of motor 330 is connected to a right angle gear box 338 by clutch and brake assembly 336. Motor 330 is ordinarily run continuously with clutch 336 disengaged. However, when forward movement of the log is desired, clutch 336 is engaged to drive right angle gear box 338, which is connected to shaft 318 by couplers 340.

As will be discussed in more detail hereinafter, the forward movement of the log may proceed in preselected increments. To this end, a control box 342 is connected to shaft 318 by reduction gear 344. Control box 342 controls the rotation of shaft 334 and actuates brake 336 after the shaft has rotated a predetermined amount so as to advance the log through the preselected increment.

When the forward movement of the log is controlled automatically by control box 342, motor 330 is operated at its higher speed of 1800 r.p.m., as discussed in more detail hereinafter. However, at this speed it has been found difficult to brake shaft 334 sufficiently accurately. Hence, braking of the shaft proceeds in two steps. First, motor 330 is switched from high speed operation to its lower speed operation. This transfer is ordinarily accomplished in approximately two revolutions of the motor. Thereafter, brake 336 is applied which brings shaft 334 to a stop in approximately two to three further revolutions. As a result, braking of shaft 334 is accomplished in a rapid and repeatable fashion.

Motor 332 is used to retract the set works to its original position after a log has been fully cut. Motor 332 ordinarily operates continuously, and the receding of the set works is accomplished by actuating clutch 348 which connects the output shaft 346 of motor 332 to shaft 350 mounted in bearings 351, 352. Shaft 350 is connected by 2/1 induction belt 354 to gear box 338. Motor 332 is a single speed motor which operates at 1800 r.p.m. which is increased by belt 354 to operate shaft 318 at a speed of 3600 r.p.m. so that the retraction of the set works can be accomplished in a minimum of time to begin processing of another log.

Figure 9:
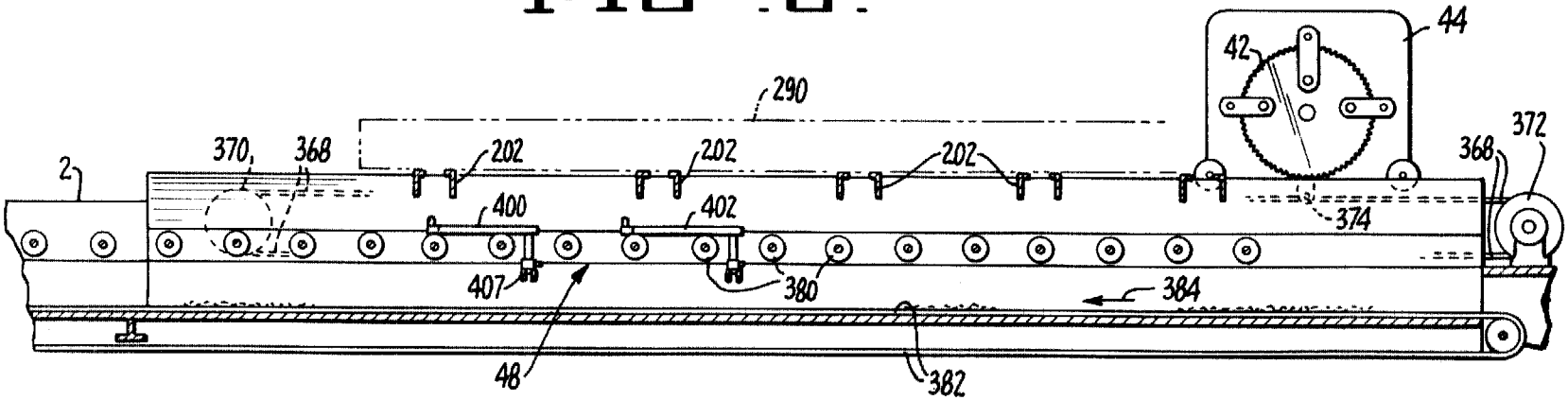

As discussed above, radial saw 42 is mounted on a saw carriage 44 which reciprocates back and forth along trailer 2, as illustrated in FIGS. 8, 9 and 12. Carriage 44 is mounted on a pair of rails 360, 362 with wheels 364, 366 respectively. Rollers 361, 363 are mounted on shafts 365, 367 extending from carriage 44 and engage the undersides of rails 360, 362 so that the carriage cannot come off the rails. The upper surface of rail 360 has an inverted truncated V-shape, and wheel 364 has a corresponding groove so that wheel 364 maintains the alignment of carriage 44. Rail 362 and its associated wheel 366 are flat and provide no guide for saw carriage 44. Thus, the alignment of the saw carriage can be adjusted simply by maintaining the alignment of rail 360, and the alignment of rail 362 is not critical.

The movement of saw carriage 44 along trailer 2 is controlled by a cable 368. Cable 368 wraps around a pully 370 at one end of rails 360, 362 and around a drum 372 at the other end of the rails. Saw carriage 44 is connected to cable 368 by connector 374 on the underside of the carriage. Drum 372 is powered as will be discussed hereinafter in either a clockwise or counterclockwise direction to move saw carriage 44 back and forth along trailer 2.

Figure 10:
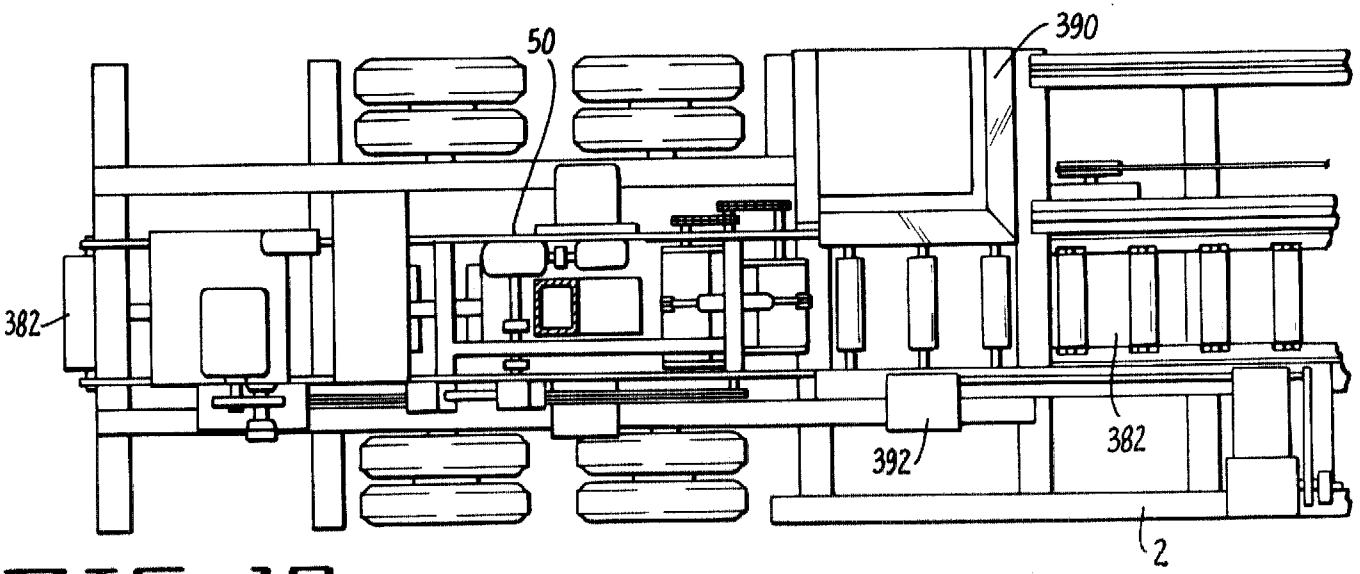
FIGS. 10 and 11 are plan and elevation views respectively of the downstream portion of trailer 2.
Figure 11:
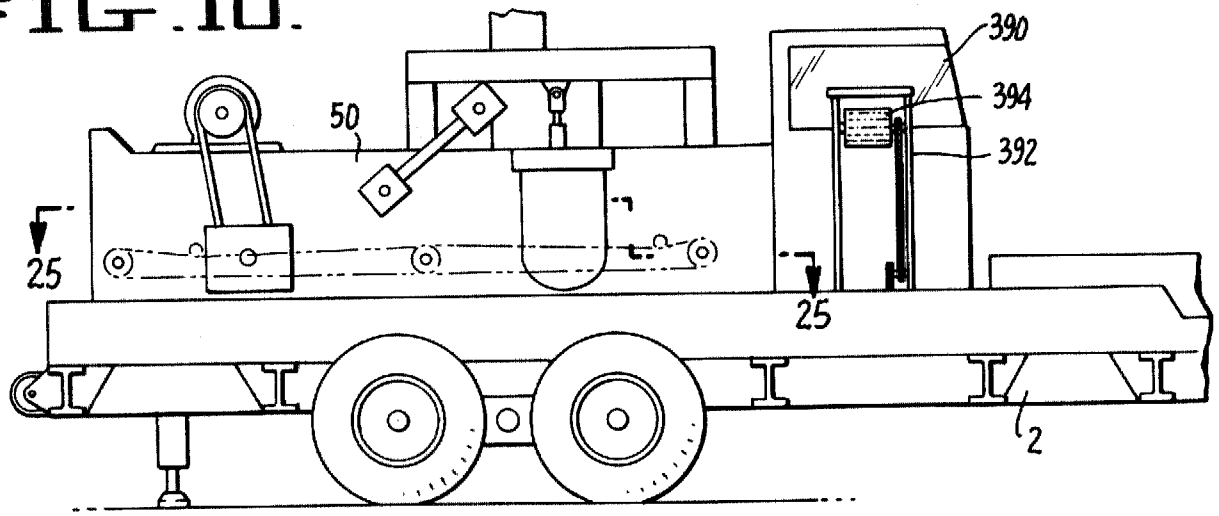

The sawing operation described hereinabove is controlled by a sawyer located in sawyer station 390 on trailer 2, as illustrated in FIGS. 10 and 11. Sawyer station 390 includes the controls over set works 40, saw carriage 44, roll case 48 and over slabber and edger 50 as will be described in more detail hereinafter, so that a single sawyer has control over all of the basic functions of the sawmill.

Figure 19:
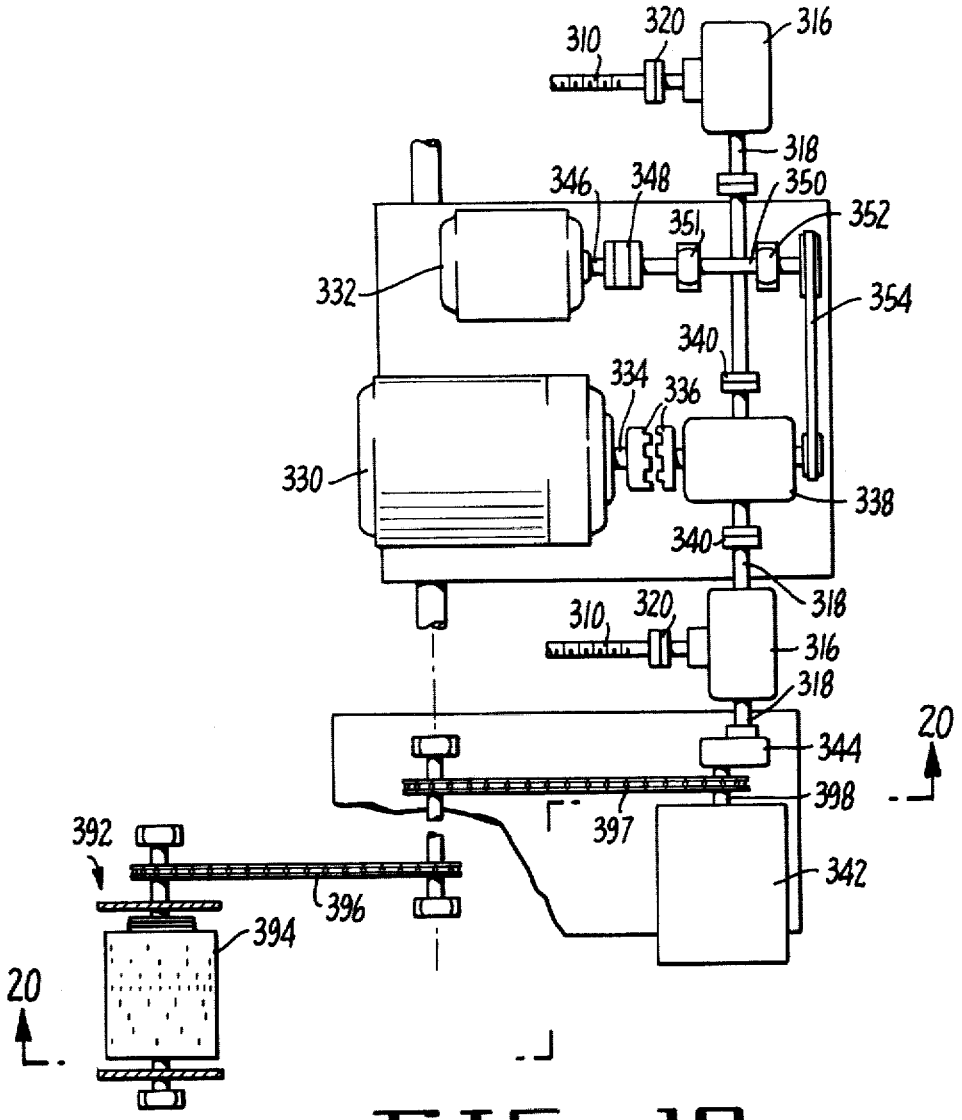
FIG. 19 is a fragmentary plan view of the power system for the set works on trailer 2.
Figure 20:
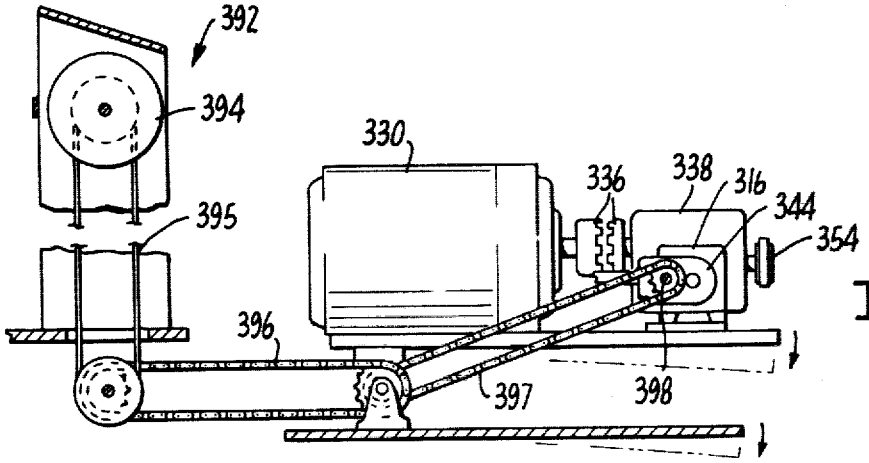
FIG. 20 is a sectional view taken along lines 20—20 of FIG. 19.

In order to guide the sawyer in sawyer station 390 in the cutting of the logs to obtain the maximum amount of usable lumber, a dial stand 392 is located just outside the sawyer station. As illustrated in FIG. 19, dial stand 392 includes a dial face 394 in the shape of a drum. The drum contaiing dial face 394 is connected by chains 396, 397 to the shaft 398 connecting control box 342 to reduction gear 344. In this manner, movement of dial 394 is related to the movement of the set works, and indicates the width of the log remaining which is still to be processed. By combining this measurement with the sawyer's visible observation of the initial diameter of the log, he can decide how best to cut the log to maximize the lumber obtained therefrom.

The sawyer in station 390 can select the depth of cut automatically using control box 342. However, initial setup of the log is accomplished by using a manual gig control, and the manual control can be used as the log is being cut instead of control box 342. When the manual control is being used, motor 330 is operated at its lower speed of 600 r.p.m. to increase the accuracy with which the log can be manipulated. When control box 342 is used, however, motor 330 can be operated at its higher speed of 1000 r.p.m. to increase the efficiency of the set works.

As illustrated in FIG. 12, each pass of radial saw 42 cuts a log section from the log 290 engaged by the set works. This log section falls onto roll case 48 beneath the set works which comprises a plurality of rollers 300. The saw dust from the cutting operation falls between rollers 380 and is collected on conveyor chain 382. As illustrated in FIG. 9, the saw dust is carried by conveyor chain 382 as illustrated by arrow 384 toward the aft end of the trailer for further processing, as will be discussed in more detail hereinafter.

The first and last log sections cut from each log by radial saw 42 will have only one flat side. In order to process these log sections with the slabber, it is essential that such log sections end up on roll case 300 with the flat side down. In addition, it is essential that all log sections be exactly centered on roll case 300 for processing by the edger, as illustrated hereinafter. To achieve these objectives a log section turning and centering apparatus is provided.

As illustrated in FIGS. 8 and 9, two pairs of arms 400, 401 and 402, 403 are superimposed over the rollers 380 in roll case 48. The free ends of arms 400, 401 are adapted to be located approximately two feet from the leading end of a log section on roll case 48. The free ends of arms 402, 403 are located approximately five feet from the free ends of arms 400, 401. Thus, when actuated as described hereinbelow, pairs of arms 400, 401 and 402, 403 will engage the log section at points two and seven feet from the leading edge of the log section.

Figure 21:
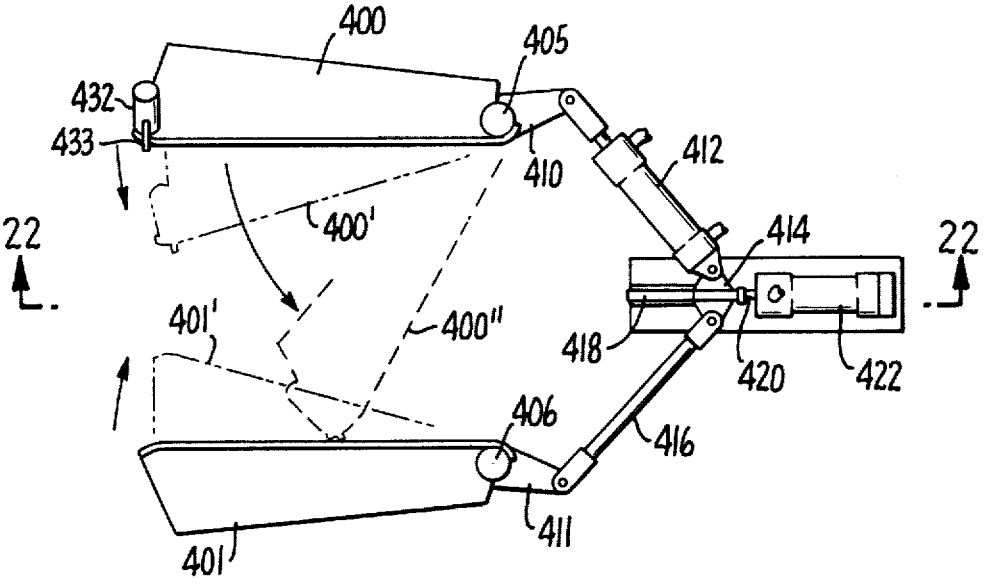
FIG. 21 is a plan view of the log section turner and centering device on trailer 2.
Figure 22:
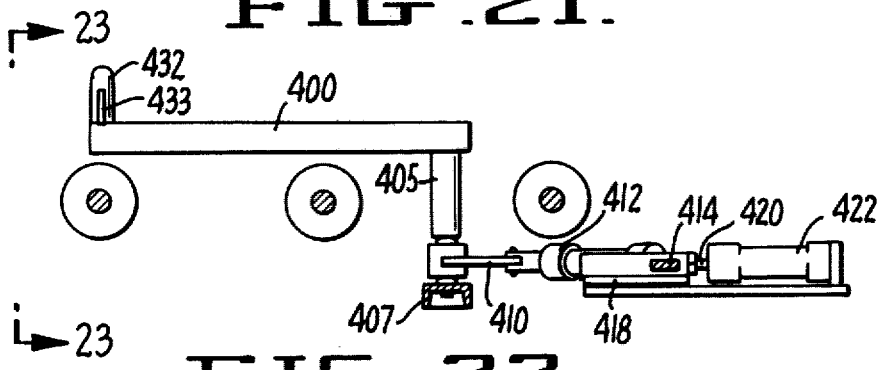
FIG. 22 is a sectional view taken along lines 22—22 of FIG. 21.

The operation of pairs of armatures 400, 401 and 402, 403 and their operating mechanism is illustrated by way of reference to FIGS. 21 and 22, wherein the operation of arms 400, 401 is illustrated by example. Operation of a pair of arms 402, 403 is identical and the two sets of arms act in unison.

Arms 401, 402 are supported on vertical struts 405, 406 respectively. Each strut 405, 406 is mounted to structure 407 so as to be rotatable about its vertical axis. Plates 410, 411 are fixed to vertical struts 405, 406 respectively. A hydraulic cylinder 412 has one end connected to flat plate 410 at a position distant from vertical strut 405, and a second end connected to a bracket 414. A strut 416 has one end connected to plate 411 at a point distant from vertical strut 406, and an opposite end also connected to bracket 414. Bracket 414 is movable along a track 418, and is connected to the output shaft 420 of hydraulic actuator 422.

Figure 24:
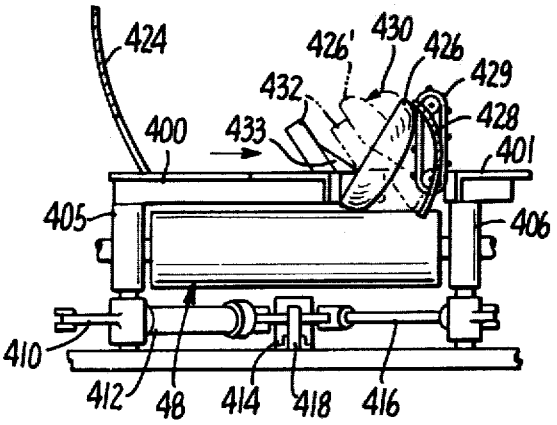
FIG. 24 is a view similar to that of FIG. 23 illustrating use of the apparatus as a log section turner.

When a log section drops onto roll case 48 after it has been cut from a log section, it initially contacts a curved plate 424 which feeds it onto roll case 48. Slab log sections, i.e., log sections having only one flat side, may or may not end up on roll case 48 with the flat side down. If not, hydraulic cylinder 412 is actuated to pivot its associated arm 400 to the position illustrated at 400'' in FIG. 21. Arm 402 is similarly actuated by a corresponding hydraulic actuator. As a result, the log section such as 426 is forced against plate 428 on one side of roll case 48, as illustrated in FIG. 24. The free end of log section 428 will be forced upwardly by vertical log turner 429 and over the other end held down by tab 433 as illustrated by arrow 430 and will come to rest against the slanted prong 432 on the upper surface of arm 400. When arm 400 (and 402) is moved back to its original position, log section 426 will fall onto roll case 48 with its flat side down.

Figure 23:
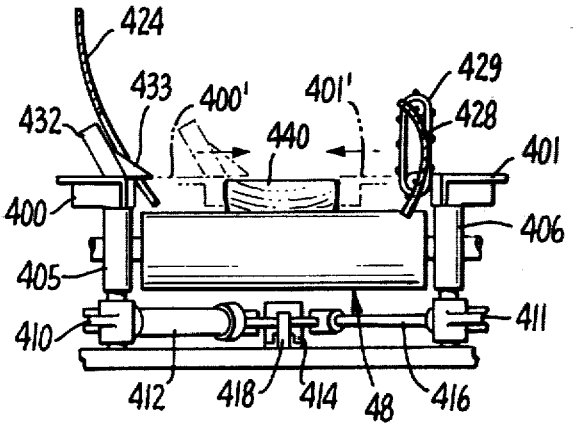
FIG. 23 is a sectional view taken along lines 23—23 of FIG. 22 and illustrating the apparatus used as a centering device.

To center a log section such as 440, hydraulic actuator 422 is actuated as illustrated in FIGS. 21 and 23. Actuation of hydraulic actuator 422 moves bracket 414 along track 418 to force arms 400, 401 inwardly to positions 400', 401' respectively. Arms 402, 403 are similarly actuated. Since the arms of each respective pair move in unison, log section 440 will be exactly centered on roll case 48.

As discussed previously, the logs are loaded onto sawmill 10 butt end first so that the larger end of the log is the leading end in subsequent processing. Accordingly, the larger end of the log section will be disposed to the aft end of trailer 2, i.e. to the left in FIG. 8. However, the butt end of the log section may be curved relative to the remainder of the section. Therefore, to appropriately center the log section, the free ends of arms 400, 401 contact the log section two feet from its leading end, a position ordinarily above any curvature at the butt end of the section. Arms 402, 403 contact the log section seven feet from its leading end, which should be above the location of any significant taper of the section. Thus, the major portion of the log section is appropriately centered to maximize the amount of usable lumber which can be obtained therefrom.

Roll case 48 transfers each log section after it has been centered to the slabber and edger 50 located at the trailing end of trailer 2 as illustrated in FIGS. 10 and 11. As the log section passes sawyer station 390, the sawyer is able to visually estimate the width of a board which can be cut from the log section after the curved edges of the section are removed. Also, the sawyer estimates the thickness of a board which can be cut from a slab section. The sawyer then sets the slabber and edger controls approximately before the board reaches slabber and edger 50. In the future, it may be desirable to automate these duties of the sawyer, and such automation is considered an alternate embodiment of the present invention.

Figure 25:
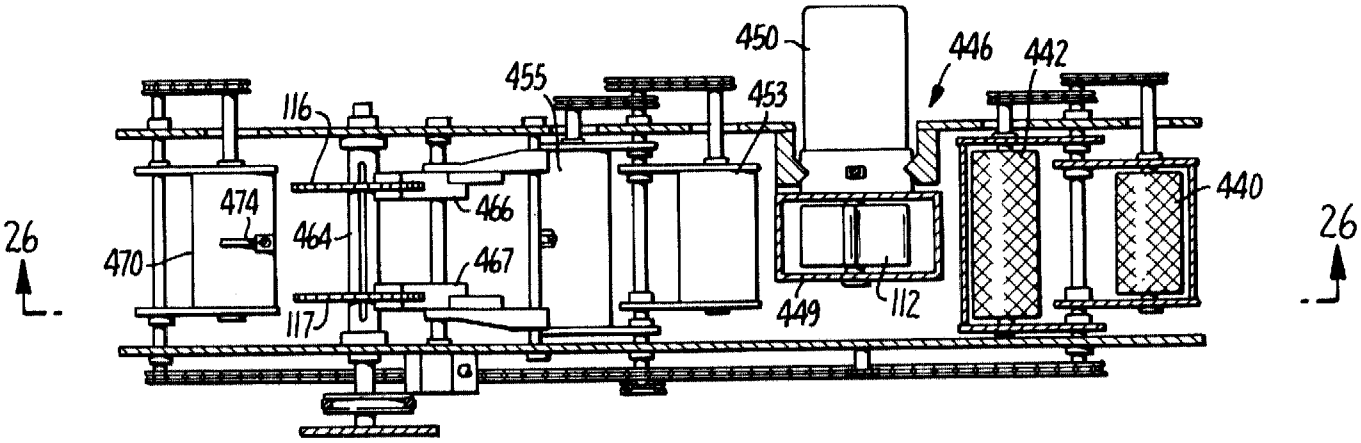
FIGS. 25 and 26 are plan and elevation views respectively of the slabber and edger on trailer 2 with the housing removed.
Figure 26:
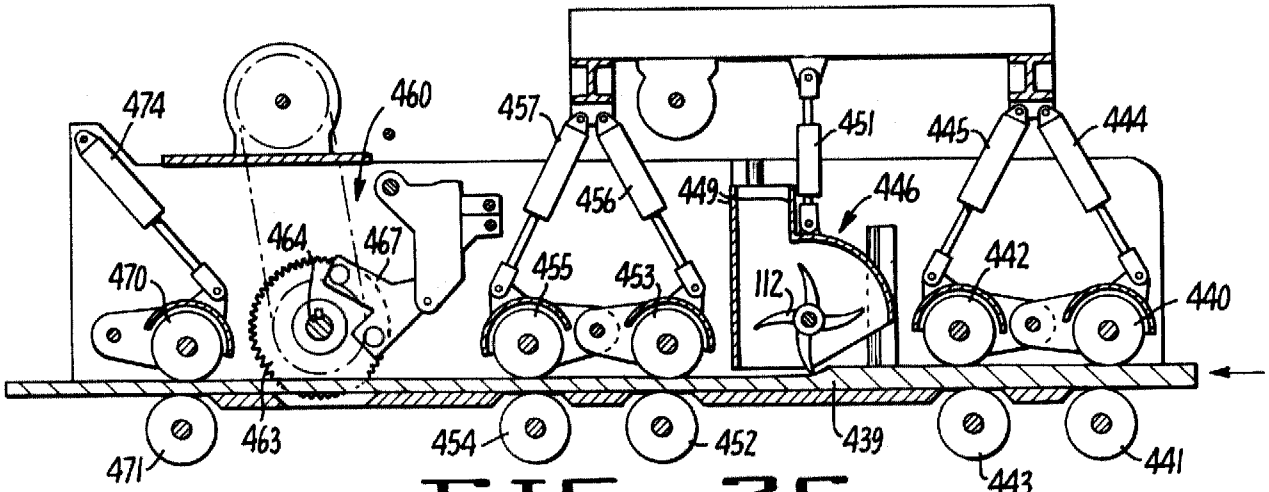
Figure 27:
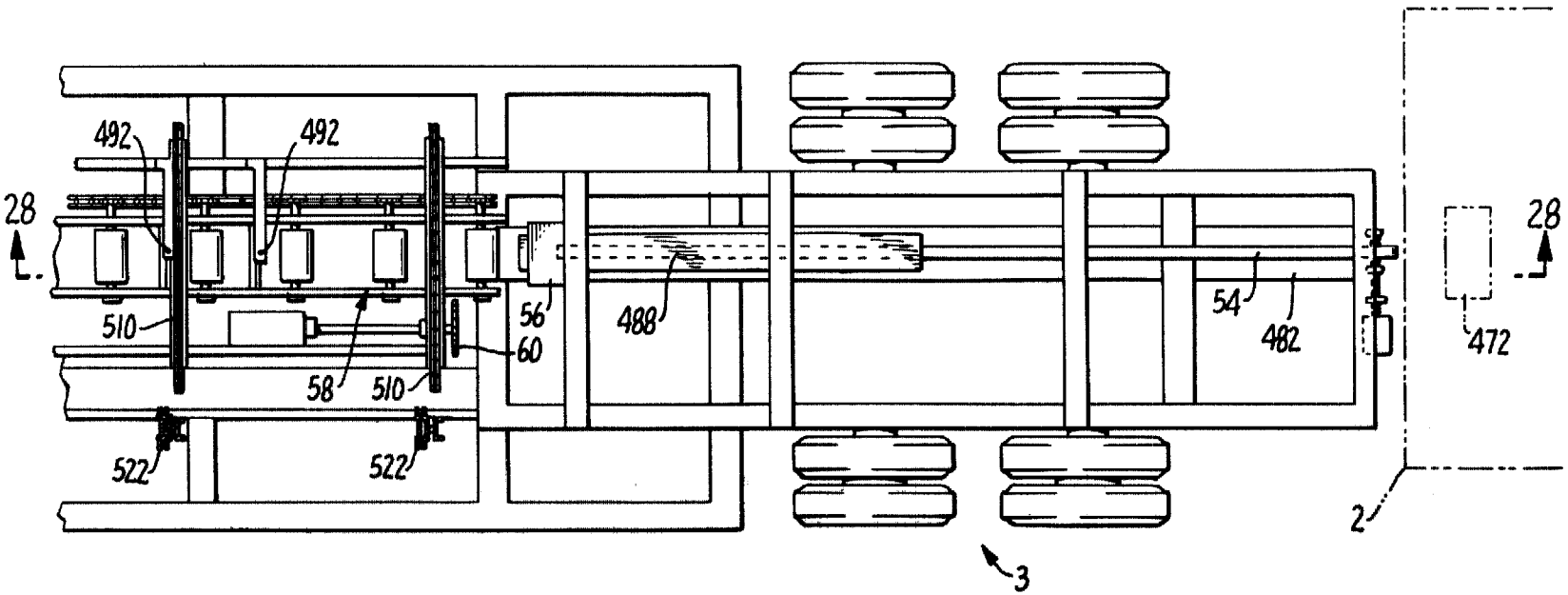
FIGS. 27 and 28 are plan and elevation views respectively of the upstream portion of trailer 3 with the power unit removed.

The internal operation of slabber and edger 50 is illustrated by way of reference to FIGS. 25 and 26 in combination. As a log section 439 enters slabber and edger 50, it passes between pairs of idler rollers 440, 441 and 442, 443. To minimize the interference of rollers 440, 442 with the travel of log section 439, rollers 440 and 442 are at least partially unweighted by actuators 444, 445, which can be either pneumatic or hydraulic actuators. Rollers 440, 442 are quite heavy for reasons discussed hereinafter. Actuators 444, 445 pull upwardly on rollers 440, 442 and lift a portion of the weight of the rollers so that the entire weight of the rollers does not rest on log section 439.

After log section 439 passes between rollers 440, 441 and 442, 443, it encounters the slabber 446. Slabber 446 comprises a cutting head 112 which includes a plurality of chipping blades which cut off a portion of the curved edge of slabbed log sections to form a flat side. After passing through slabber 446, such log sections have parallel flat surfaces on each side. Chipping head 112 is driven by a motor 450, and is located in housing 449. The height of the chipping head is controlled by actuator 451. The height of chipping head 112 is set by the sawyer, as discussed previously. If a normal log section having two flat sides is being fed into slabber and edger 50, slabber 446 is raised sufficiently so that the log section will pass freely under chipping head 112 and is not processed by the slabber.

After traversing slabber 446, log section 439 passes between opposed pairs of driven rollers 402, 453 and 454, 455. Again, upper rollers 453, 455 are unweighted by actuators 456, 457 so that the full weight of the rollers does not bear against the log sections.

After passing between rollers 452, 453 and 454, 455, log section 439 encounters edger 460. Edger 460 comprises a spaced pair of radial saw blades 116, 117. Blades 116, 117 are free to move transversely along shaft 464, and their positions thereon are controlled by collars 466, 467. The distance between blades 116, 117 is specified by the sawyer so that only the curved edges of the log section are removed. The section is thus edged so that it has a substantially rectangular cross section and has the shape of a board. A slight kerf (curved edge) may be left on the board by edger 460, which will be trimmed during finishing of the board to produce finished lumber.

After passing through edger 460, the board passes between a pair of driven rollers 470, 471. Again, upper roller 470 is unweighted by actuator 474.

It has been found that the rollers overlying log section 439 as it passes through slabber and edger 50 must be relatively massive in order to maintain the alignment of the section as it is being slabbed and edged. However, if such massive rollers are allowed to bear directly on the log section, the section itself may be damaged, and it may be difficult to insert the leading edge of the section between the rollers. Thus, it has been found advantageous to provide the massive rollers required to maintain the alignment of the log sections, but to partially unweight the rollers as illustrated so that the sections can enter freely between the rollers and are not damaged.

Trailer 3—Detailed Description

Figure 28:
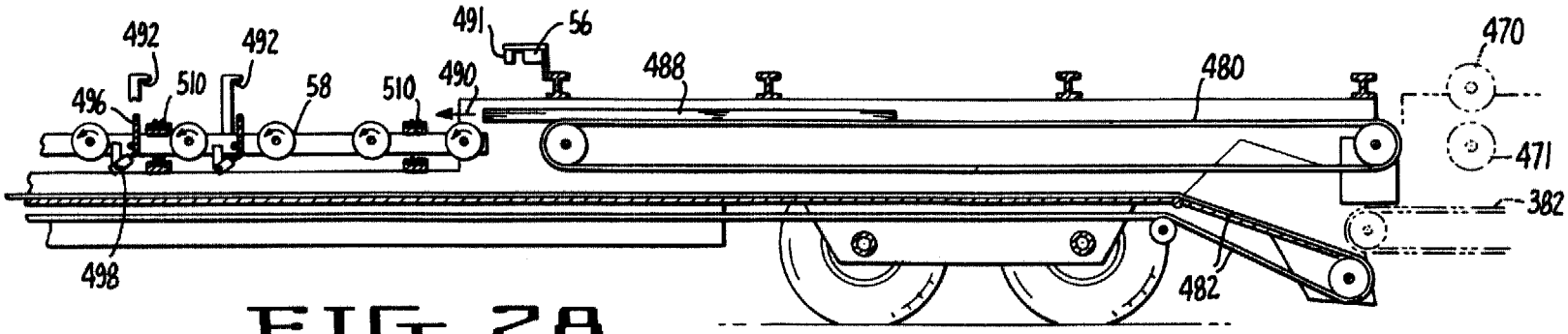

After the board passes between the last pair of rollers 470, 471 on trailer 2, it passes onto an elongate belt 54 on trailer 3 which acts as an edger picker, as illustrated in FIG. 28. The sawdust and other refuse on conveyor chain 382 is dumped onto a corresponding conveyor 482 on trailer 3. Thus, both the board and the refuse on trailer 2 are passed along onto trailer 3 for further processing.

Figure 33:
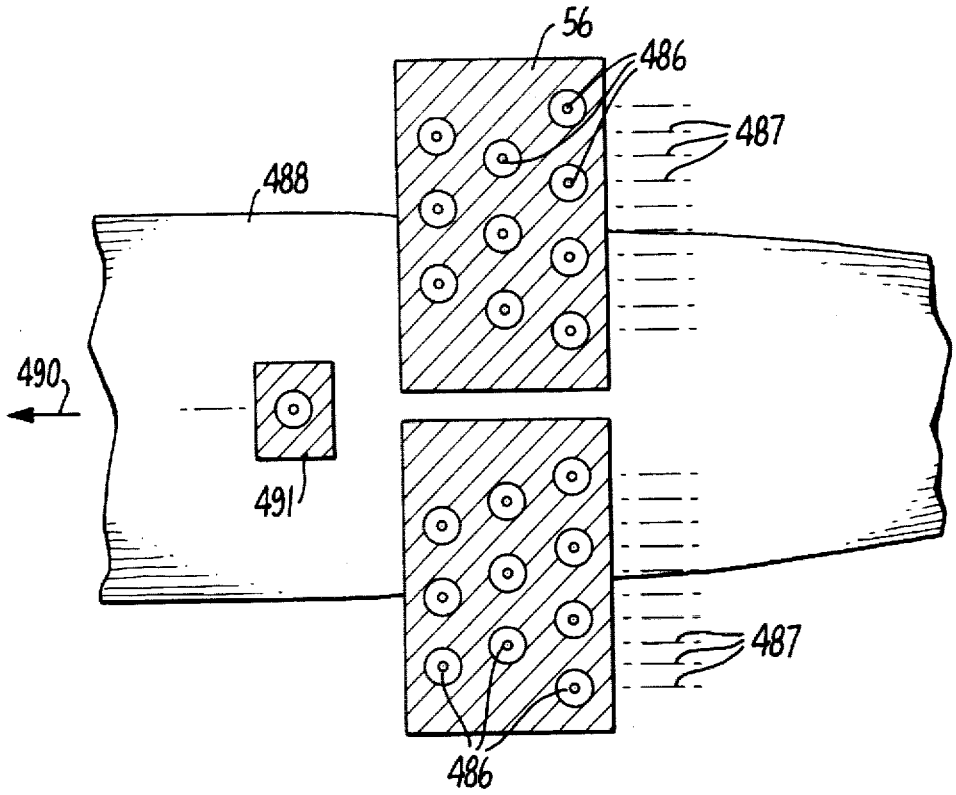
FIG. 33 is a schematic sectional view of the transverse array of optical sensors on trailer 3.

As the board reaches the end of edger picker 54, it passes under an optical sensor 56. As illustrated in FIG. 33, optical sensor 56 comprises a plurality of optical sensing elements 486 arranged in a transverse array as illustrated by axes 487. As a board such as 488 passes beneath optical sensor 56 as illustrated by arrow 490, FIG. 28, sensor 56 determines the initial width of the board.

As discussed previously, the leading end of the board is ordinarily the widest portion of the board. As the board passed through the edger on trailer 2, the edger cut the sides of the board so that the board has a leading constant width portion. However, the trailing end of the board may taper inwardly so as not be affected by the edger. Thus, board 488 will have a leading constant width portion and a tapered trailing end.

After sensor 56 has determined the width of the constant width portion of the board, it then determines the point at which the board begins to taper, i.e. when the width of the board is less than its constant width portion. The point at which the board begins to taper can be determined in two ways. One method is to compute the distance of the board on each side of the centerline of the array of sensing elements 486, and consider that the board has begun to taper when the width of the board on either side of the centerline begins to decrease. The second method is to compute the total width of the board, and determine when this total width begins to decrease. The second method is preferred because it more accurately determines when a curved board begins to taper, whereas the first method erroneously assumes that the board has begun to taper due to curvature alone.

If the board has a constant width along its entire length, passage of the trailing end of the board past the transverse array 56 of sensing elements is determined by optical sensing element 491.

Figure 29:
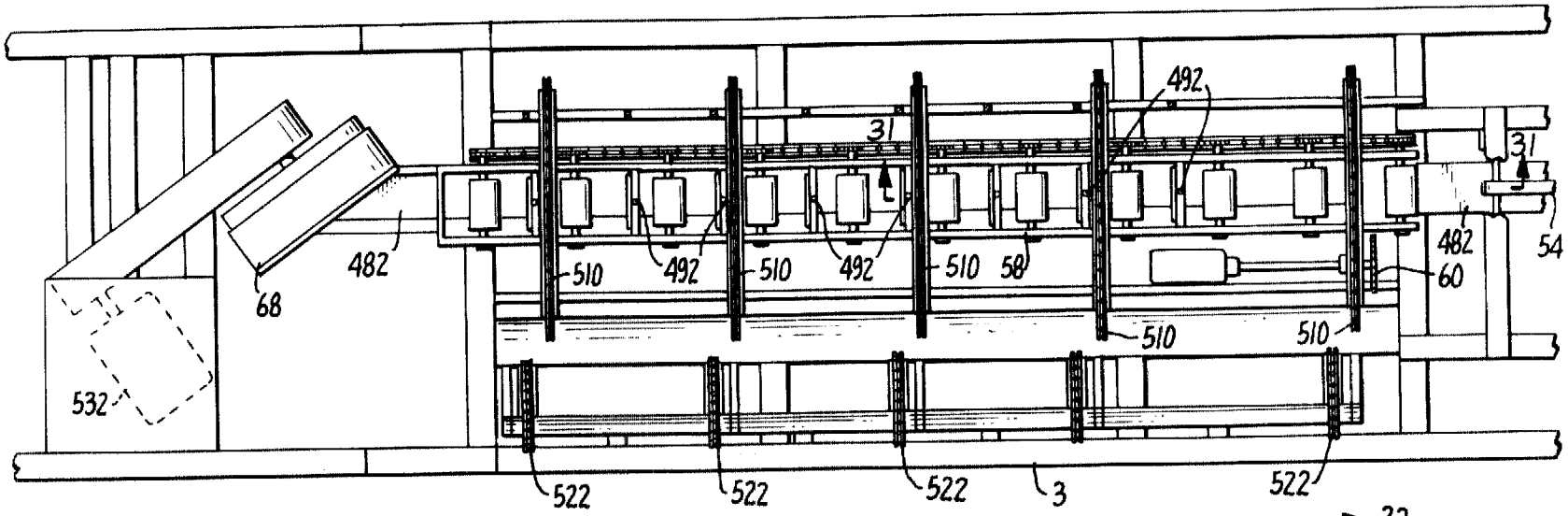
FIGS. 29 and 30 are plan and elevation views respectively of the downstream portion of trailer 3.
Figure 30:
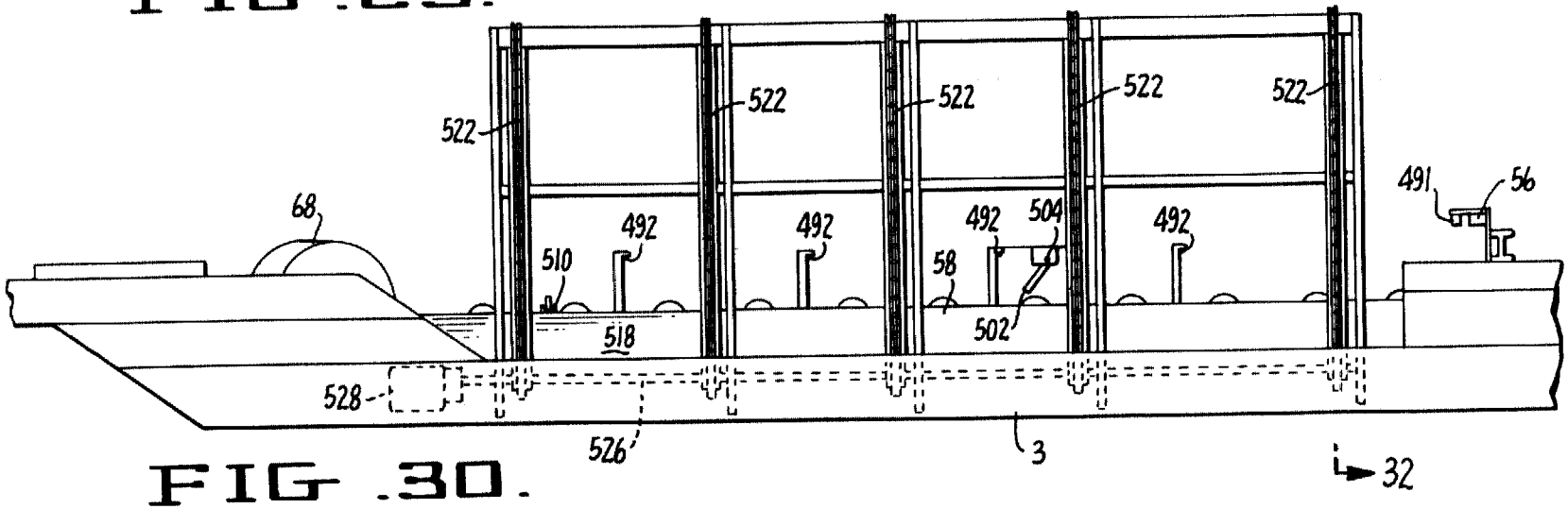

As the board passes beneath the transverse array 56 of sensor elements, it moves onto a roll case 58 on trailer 3 as illustrated in FIGS. 29 and 30. The board passes beneath a plurality of optical sensors 492 disposed along roller case 58. When optical sensor 56 determines that the board has begun to taper, or when element 491 determines the entire board has passed the sensor, control center 494 takes a reading from the longitudinal array of sensors 492 to determine the length of the board which has a constant width (see FIG. 34).

Figure 31:
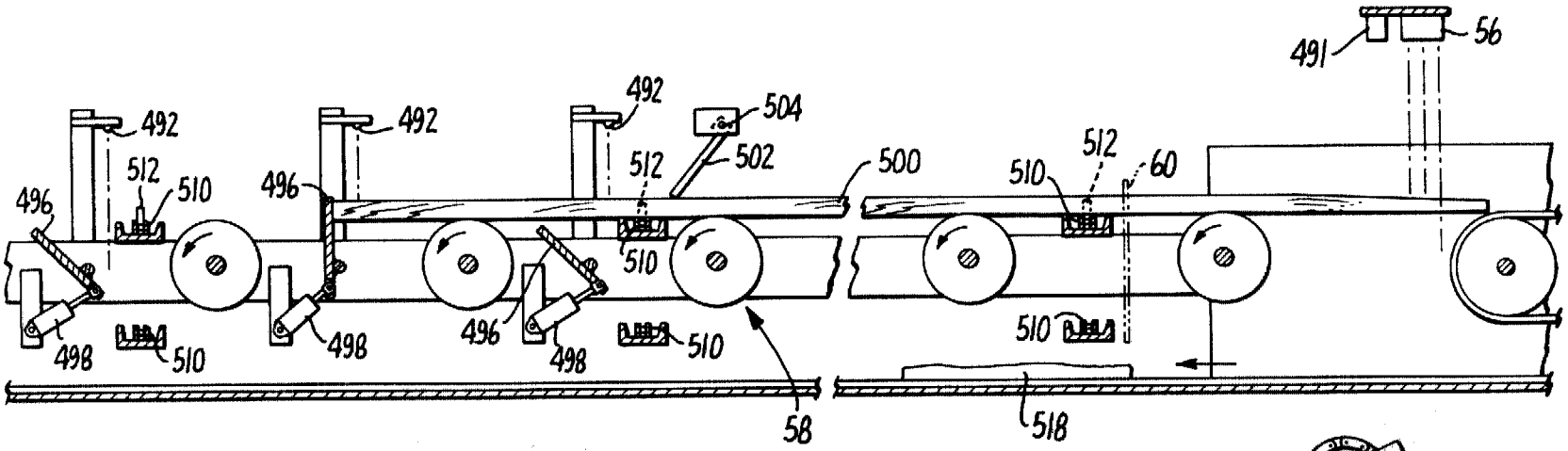
FIG. 31 is a sectional elevation view taken along lines 31—31 of FIG. 29.
Figure 34:
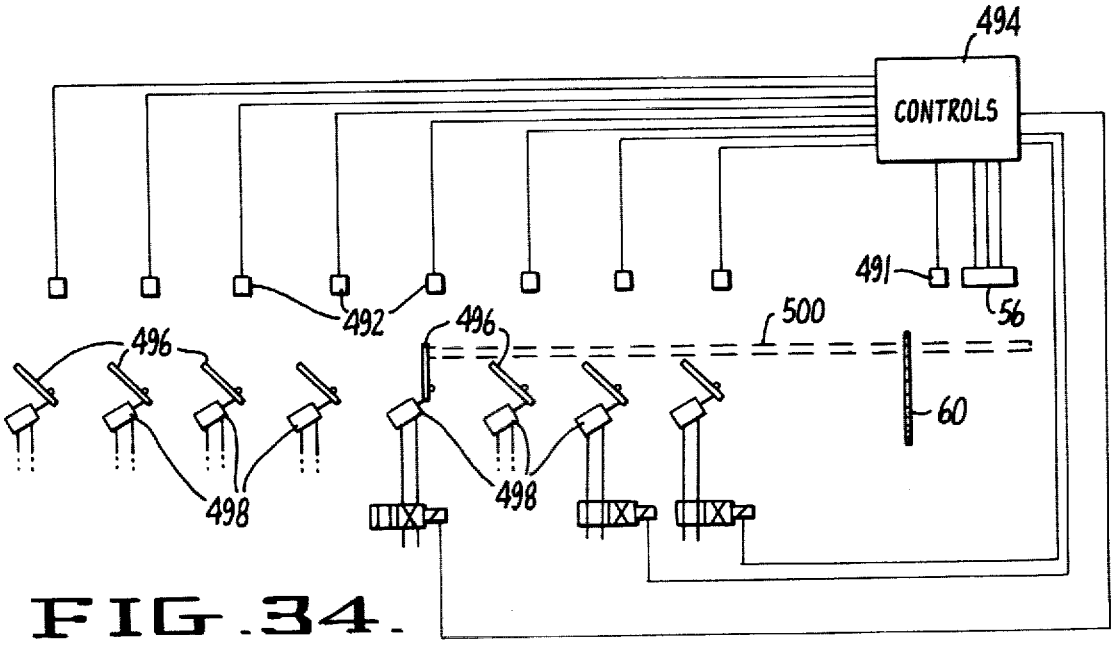
FIG. 34 is a schematic view of the automated trimmer on trailer 3.

An array of angularly inclined pivotably mounted plates 496 are interspersed between the respective rollers of roll case 58 as illustrated in FIGS. 31 and 34. The inclination of the plates prevents the leading end of a curved board from ducking down between rollers. The pivotable position of each angularly inclined plate 496 is controlled by a hydraulic actuator 498. After control center 494 determines the length of board 500 which has a constant width, the appropriate hydraulic actuator 498 is actuated to pivot its corresponding plate 496 into a vertical configuration to stop the board so that the position along the board at which it begins to taper is adjacent the blade of radial trim saw 60. Anti-rebound gate 502 is suspended from frame 504 and rests on the upper surface of board 500 at an angle to prevent rebounding of the board after it contacts the selected plate 496.

Figure 32:
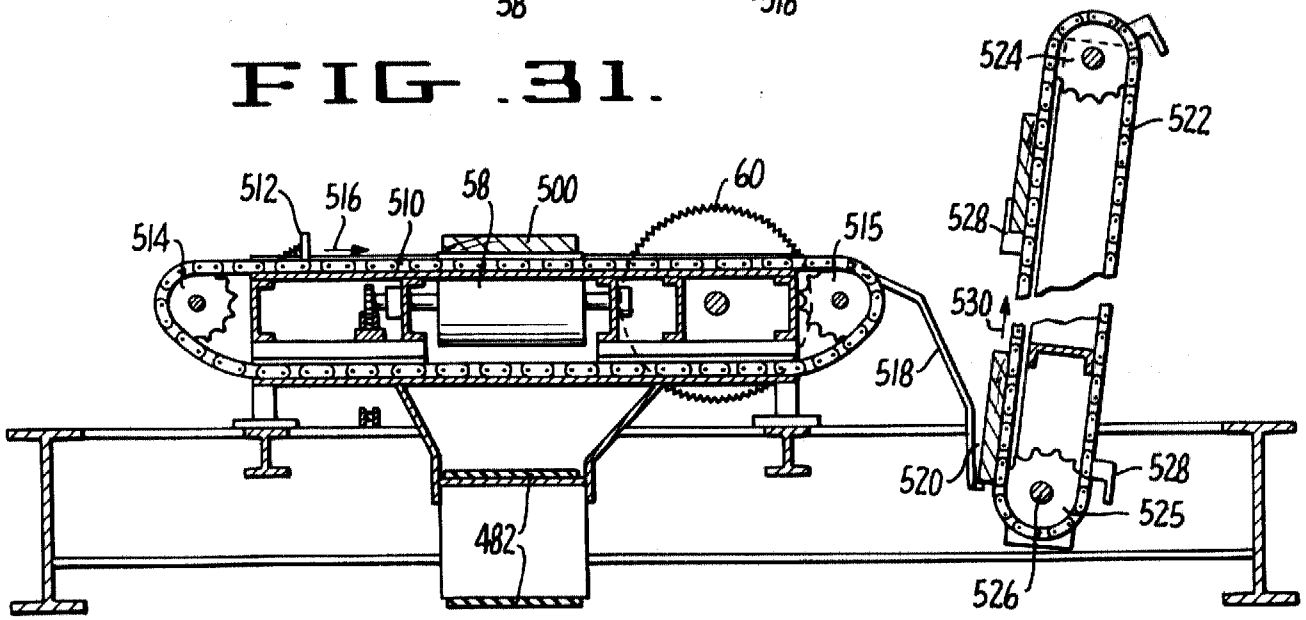
FIG. 32 is a sectional elevation view taken along lines 32—32 of FIG. 30.

As illustrated in FIG. 29, a plurality of laterally disposed chains 510 span roll case 58. Referring to FIG. 32, wherein one such chain 510 is depicted by way of example, a raised projection 512 is located on the chain. As chain 510 is driven by sprockets 514, 515 as illustrated by arrow 516, board 500 is moved off roll case 58 so that it intersects the blade of trim saw 60. The tail or tapered end 518 of the board is thus trimmed and falls onto conveyor 482, as depicted in FIG. 31. The constant width portion of the board remains on chains 510.

As illustrated in FIG. 32, the constant width portion of the board slides off chains 510 and down a ramp 518 into slot 520 adjacent stacker 64. Stacker 64 comprises a plurality of chains 522 (see also FIG. 30) mounted on pairs of sprockets 524, 525. The respective lower sprockets 525 are mounted on a shaft 526 which is driven by motor 528 to drive the chains. Each chain 522 has one or more angles 528 disposed thereon adapted to engage a board in slot 520 and move it upwardly along the chain as illustrated by arrow 530. When the board reaches the top of chain 522, it is dumped onto the ground or onto a trailer for further processing.

All of the materials on conveyor 482, which include the sawdust from radial saw 42, the edges of the board from edger 460, and the trimmed end of the board from trim saw 60 are passed to chipper and blower 68. Chipper and blower 68 is powered by a motor 532 and processes this material into chips. As discussed previously, these chips and the chips from the slabber are forced by chipper and blower 68 into a chip trailer and are used in various applications so that none of the log is wasted.

It is apparent that, while a preferred embodiment of the present invention has been disclosed in detail, modifications and adaptations of that embodiment may occur to those skilled in the art. It is to be expressly understood, however, that such modifications and adaptations are within the spirit and scope of the present invention, as set forth in the following claims.

What is claimed is:

1. A method of producing lumber from a supply of generally round logs which have bent ends, comprising the steps of:

dropping a log on a set works so that the bent ends of the log point downwardly;

dogging the log with its bent ends pointed downwardly;

then rotating the set works through a pre-selected arc of approximately 45° to incline the bent ends of the log from the vertical; and thereafter sawing the log into lumber.

2. A method of producing lumber from a supply of generally round logs which have bent ends, comprising the steps of:

providing a set works with horizontal knee members and vertical knee members intersecting at approximately right angles to each other;

rotating the set works through a forward arc of approximately 45° about an axis perpendicular to the knee members, the knee members of the set works thus providing upwardly opening V-shaped receptacles for a log;

dropping the log onto the receptacles of the set works so that the log assumes a position on the set works with the bent ends of the log pointing downwardly;

dogging the log in said position;

rotating the set works through a reverse arc of approximately 45° to return the knee members to their original horizontal and vertical orientations; and thereafter sawing the log into lumber.

* * * * *